US009523359B1

(12) United States Patent
Geschwender

(10) Patent No.: US 9,523,359 B1
(45) Date of Patent: Dec. 20, 2016

(54) LINEAR PERISTALTIC PUMP HAVING OPPOSING STAGGERED CURVED SURFACES

(71) Applicant: Robert C. Geschwender, Lincoln, NE (US)

(72) Inventor: Robert C. Geschwender, Lincoln, NE (US)

( * ) Notice: Subject to any disclaimer, the term of this patent is extended or adjusted under 35 U.S.C. 154(b) by 0 days.

(21) Appl. No.: 14/288,704

(22) Filed: May 28, 2014

Related U.S. Application Data

(63) Continuation of application No. 13/758,769, filed on Feb. 4, 2013, now Pat. No. 8,777,597.

(51) Int. Cl.
*F04B 43/12* (2006.01)

(52) U.S. Cl.
CPC ..... *F04B 43/1223* (2013.01); *F04B 43/1253* (2013.01)

(58) Field of Classification Search
CPC ..... F04B 43/12; F04B 43/153; F04B 43/1292; F04B 43/08; F04B 43/082; F04B 43/1223; F04B 45/08
USPC ..... 417/474, 475, 476, 477.1–477.9, 417/477.11–477.14
See application file for complete search history.

(56) References Cited

U.S. PATENT DOCUMENTS 1,922,196 A 8/1933 Butler
2,794,400 A * 6/1957 Bodine, Jr. ..... F04B 43/14 417/476
2,818,815 A 1/1958 Corneil
3,083,647 A 4/1963 Muller
3,137,241 A 6/1964 Isreeli
3,447,478 A * 6/1969 Clemens ..... F04B 43/1253 417/477.8
4,561,830 A 12/1985 Bradley
4,671,792 A 6/1987 Borsanyi
4,746,279 A 5/1988 Manella
4,758,228 A * 7/1988 Williams ..... 604/153
4,909,710 A 3/1990 Kaplan et al.
5,340,290 A * 8/1994 Clemens ..... F04B 43/1292 417/477.1
5,387,088 A * 2/1995 Knapp et al. ..... 417/53
5,511,951 A 4/1996 O'Leary
5,620,313 A * 4/1997 Fockenberg ..... F04B 43/12 417/475
5,660,529 A 8/1997 Hill
RE37,074 E * 2/2001 Danby ..... F04B 43/082 251/9
7,828,534 B2 * 11/2010 Habr ..... F04B 43/12 417/474

(Continued)

FOREIGN PATENT DOCUMENTS

DE 3202251 A1 8/1983
EP 426273 A1 5/1991

(Continued)

*Primary Examiner* — Alexander Comley
*Assistant Examiner* — Nathan Zollinger
(74) *Attorney, Agent, or Firm* — Suiter Swantz pc llo

(57) ABSTRACT

A pump producing peristaltic pumping action by sequentially occluding a tube between staggered curved surfaces. The pump includes a pump frame with a platen with a plurality of curved surfaces. The curved surfaces of the platen operatively interact with opposing curved surfaces on a pressure plate assembly or the like. Pumping is accomplished via a tube sandwiched between the platen and the pressure plate assembly.

4 Claims, 47 Drawing Sheets

(56) References Cited

U.S. PATENT DOCUMENTS

| | | | |
|---|---|---|---|
| 7,854,600 | B2 | 12/2010 | Ogawa |
| 8,337,168 | B2 | 12/2012 | Rotem et al. |
| 8,366,420 | B1 | 2/2013 | Geschwender |
| 8,382,447 | B2 | 2/2013 | Wang et al. |

FOREIGN PATENT DOCUMENTS

| | | | | | |
|---|---|---|---|---|---|
| GB | 2238083 | A * | 5/1991 | ..... | A61M 5/14228 |
| WO | WO 9209805 | A1 * | 6/1992 | | |

* cited by examiner

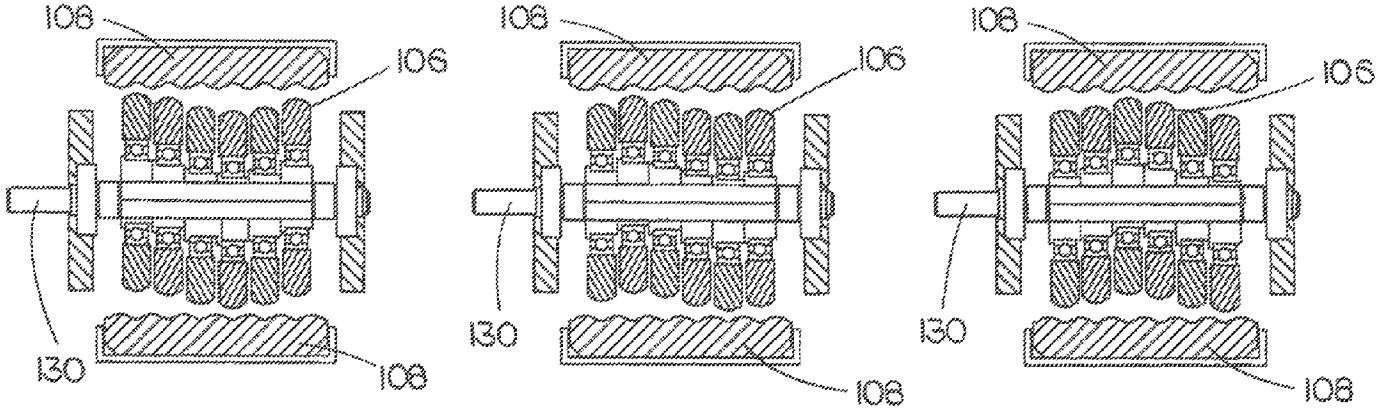
FIG. 10A
FIG. 10B
FIG. 10C
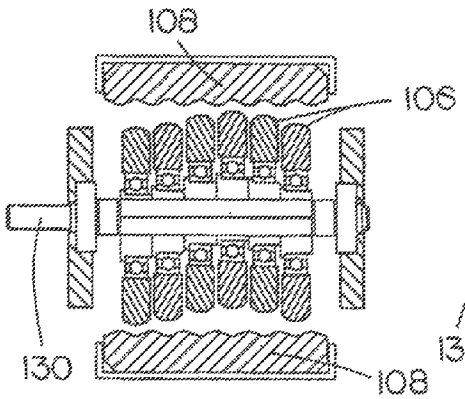
FIG. 10D
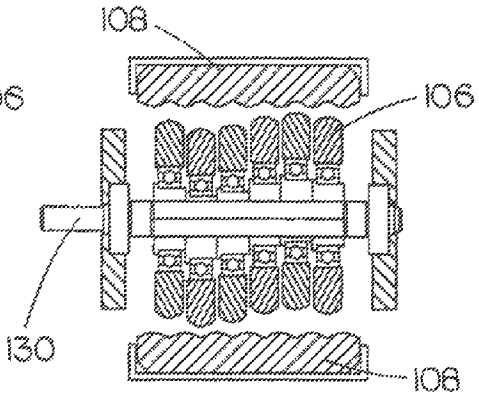
FIG. 10E
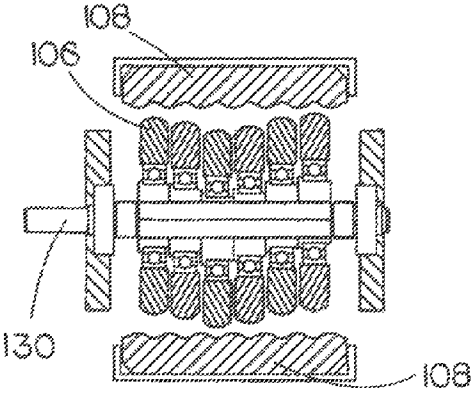
FIG. 10F

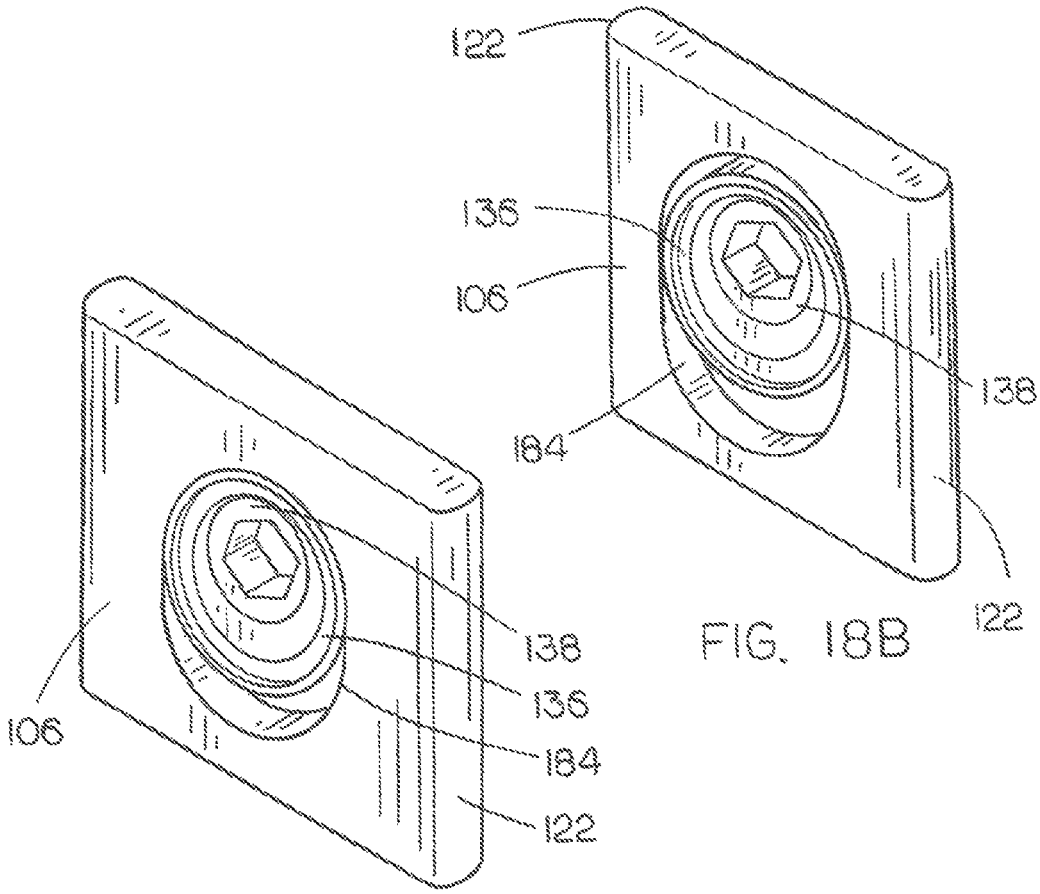
FIG. 18B
FIG. 18A
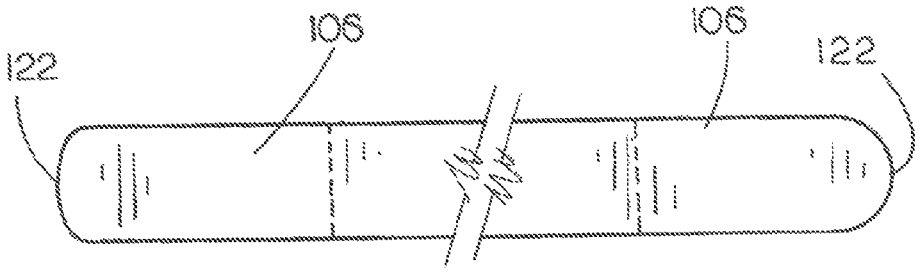
FIG. 18C

LINEAR PERISTALTIC PUMP HAVING OPPOSING STAGGERED CURVED SURFACES

CROSS-REFERENCE TO RELATED APPLICATIONS

The present application is a continuation of, and claims priority under 35 U.S.C. §120 to, U.S. patent application Ser. No. 13/758,769, filed Feb. 4, 2013, entitled Linear Peristaltic Pump Having Opposing Staggered Curved Surfaces, now pending. Said U.S. Patent Application is herein incorporated by reference in its entirety.

TECHNICAL FIELD

The present invention is generally related to positive displacement pumps utilizing a peristaltic pumping action and more particularly to linear peristaltic pumps.

BACKGROUND OF THE INVENTION

In fluid pumping applications where cross contamination between a pump and the fluid to be pumped must be avoided, peristaltic pumps are preferred. There are generally two types of peristaltic pumps, namely rotary, and linear. Rotary peristaltic pumps utilize a rotor with a number of protuberances around the rotor's circumference or shaft. As the rotor rotates the protuberances (e.g., rollers, shoes, wipers, and the like) sequentially occlude the flexible tube. The part of the tube under compression closes (or "occludes") thus forcing the fluid through the tube. As the tube opens to its natural state (after each compression) fluid is restored inducing pumping action. This process has several analogs in biology and is called peristalsis, e.g., the gastrointestinal tract. Also known in the art of peristaltic pumps are linear peristaltic pumps.

SUMMARY OF THE INVENTION

The present invention is an improved linear peristaltic pump. This pump sequentially occludes a malleable resilient tube or hose between staggered opposed curved surfaces so as to peristaltically force flow-able materials through the tube or hose. The embodiment of the peristaltic pump incorporates a pump frame with a platen or platens and movable pressure plates. The platen or platens have a series of parallel raised curved surfaces which are perpendicular to the flow through the pump. The pressure plates with curved surfaces are parallel to the curved surfaces of the platen or platens and are positioned in a staggered opposed relationship to the curved surfaces of the platen or platens and they operatively interact in a sequential wave pattern against the platen or platens. This sequence of motion manipulates the tube or hose over the alternating staggered opposed curved surfaces as the pressure plates are actively moved in a wave pattern by the drive assembly operatively associated with the pump frame, to occlude the tube or hose, thus moving the flow-able material through the tube or hose. In another embodiment, in lieu of a platen, a second set of pressure plates is incorporated with the first set of pressure plates, each set being in staggered opposed relationship with the other and in reverse phase with each other, so as to occlude the transfer tube or hose between staggered curved surfaces in a wave pattern to promote flow through the tube or hose.

A first object of the present invention is to provide an improved peristaltic pump.

A second object of the present invention is to provide an improved linear peristaltic pump.

A third object of the present invention is to provide a linear peristaltic pump that produces a quasi-continuous flow.

A fourth object of the present invention is to provide a linear peristaltic pump which reduces backflow.

A fifth object of the present invention is to provide a peristaltic pump capable of drawing a vacuum in excess of 27 inches of mercury (approximately 70 Torr) at ambient standard temperature and pressure and producing pumping pressures of less than or equal to the failure limit of a flexible resilient hose or tube (hereinafter "tube").

A sixth object of the present invention is to provide a method of pumping a fluid peristaltically between staggered curved surfaces.

A seventh object of the present invention is to provide an adjustable peristaltic pump.

An eighth object of the present invention is to provide a peristaltic pump capable of accurately mixing different pumpable materials at a desired ratio.

A ninth object of the present invention is to provide a peristaltic pump that may be adjusted to pump at different rates.

A tenth object of the present invention is to provide a peristaltic pump which without adjustment can accommodate tubes of varying diameters and like wall thicknesses.

An eleventh object of the present invention is to provide a peristaltic pump that may be easily adjusted to produce varying pressures.

A twelfth object of the present invention is to provide a peristaltic pump that may accommodate a number of stations, nozzles, and/or outputs.

These and other objects of the present invention will be apparent upon a review of this specification and its appended drawings.

BRIEF DESCRIPTION OF THE DRAWINGS

FIGS. 10A through 10F are top cross-sectional partial views of a mono-lateral peristaltic pump pressure plate drive assembly illustrating the serpentine pumping action and phase difference between opposing sides of the pressure plates and their respective platens at 60° drive shaft rotation intervals;

FIGS. 18A, 18B, and 18C are perspective views of three means for adjusting a presently preferred embodiment of the present invention to different outputs by configuring the pressure plates differently (tube diameters and tube wall thicknesses) wherein 18A utilizes a longer pressure plate, 18B utilizes a larger eccentric, and 18C utilizes different pressure plate end radiuses;

FIGS. 21 et al., 22, et al., and 23 et al., are schematic diagrams:

Figure 24:
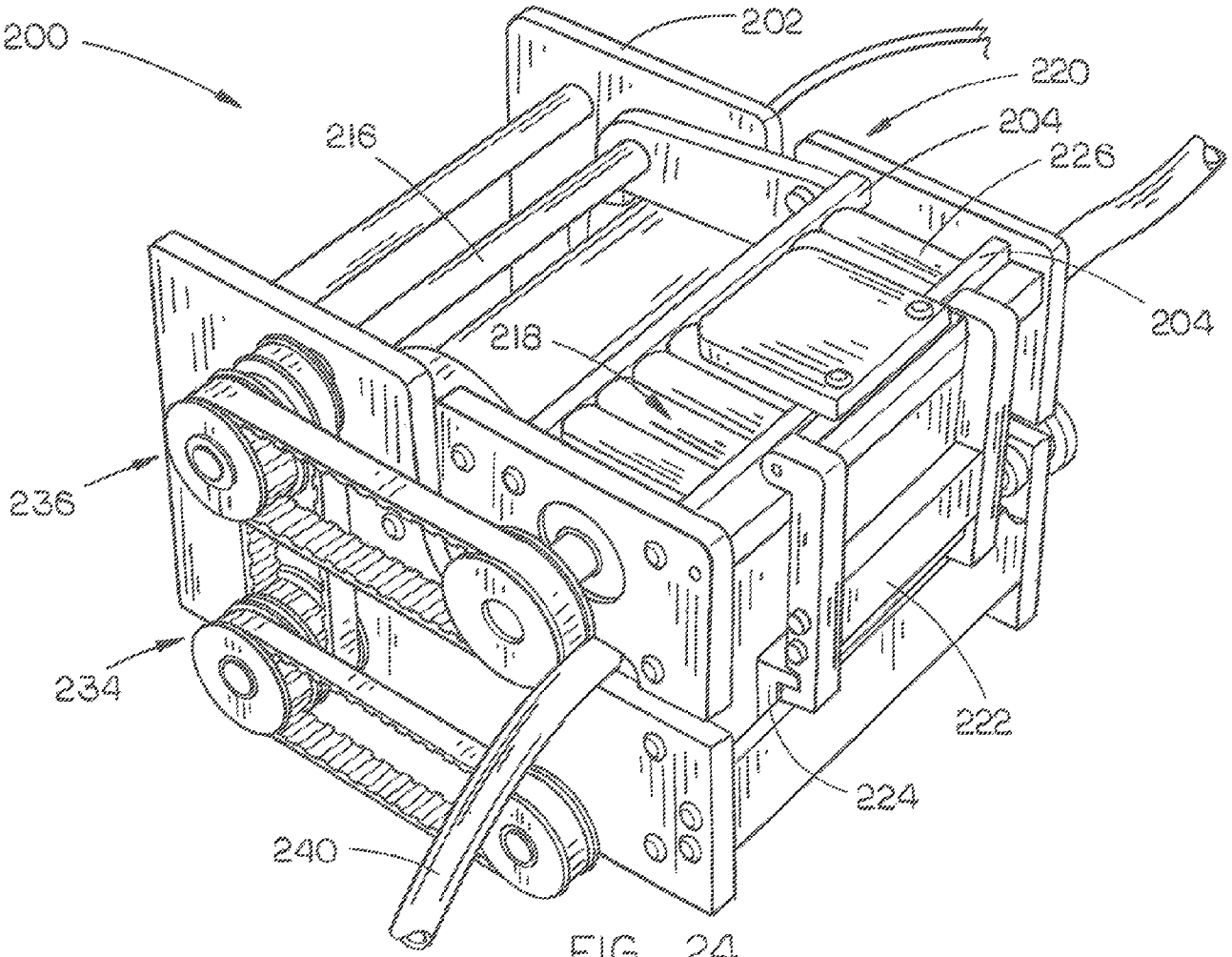
Figure 25:
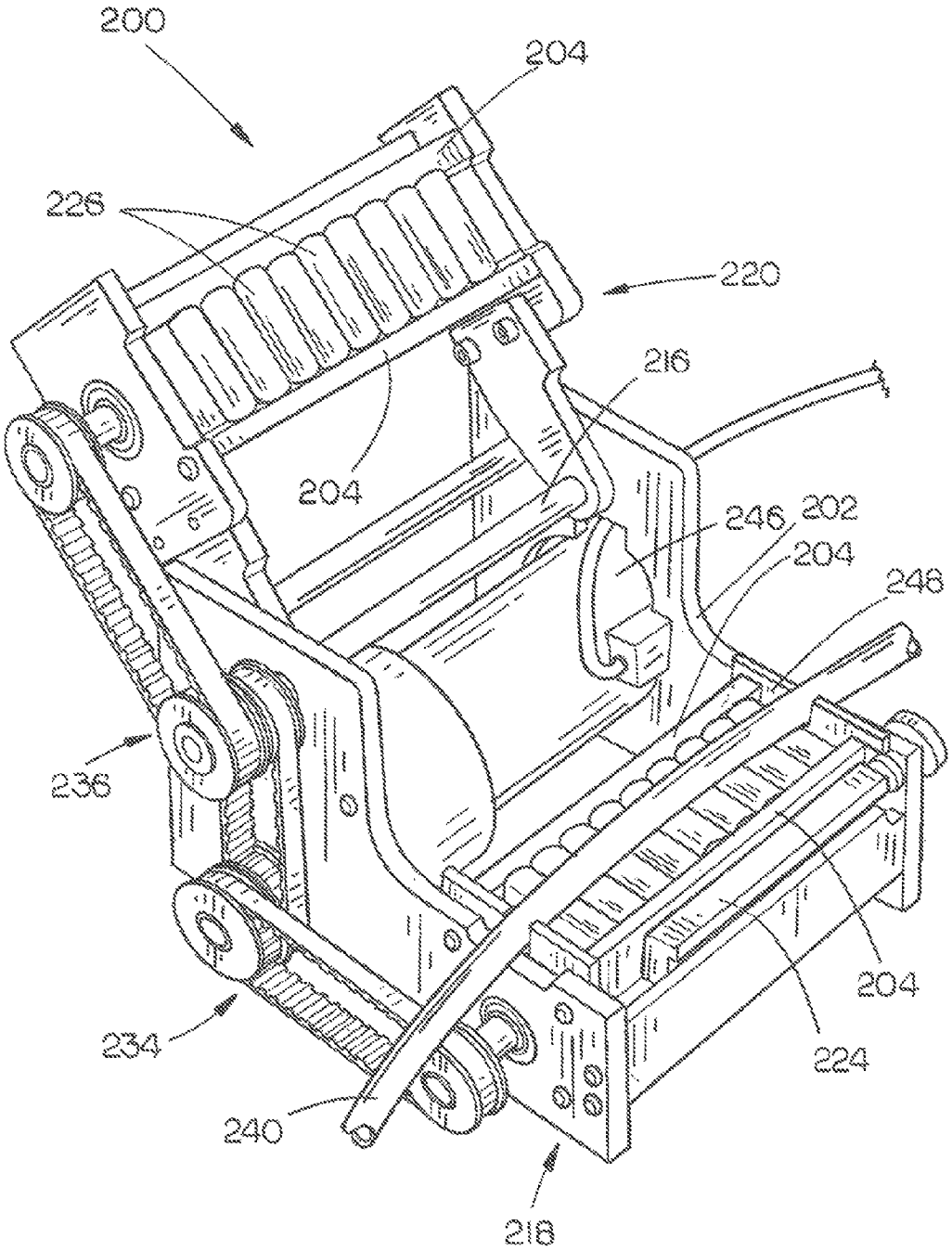
Figure 26:
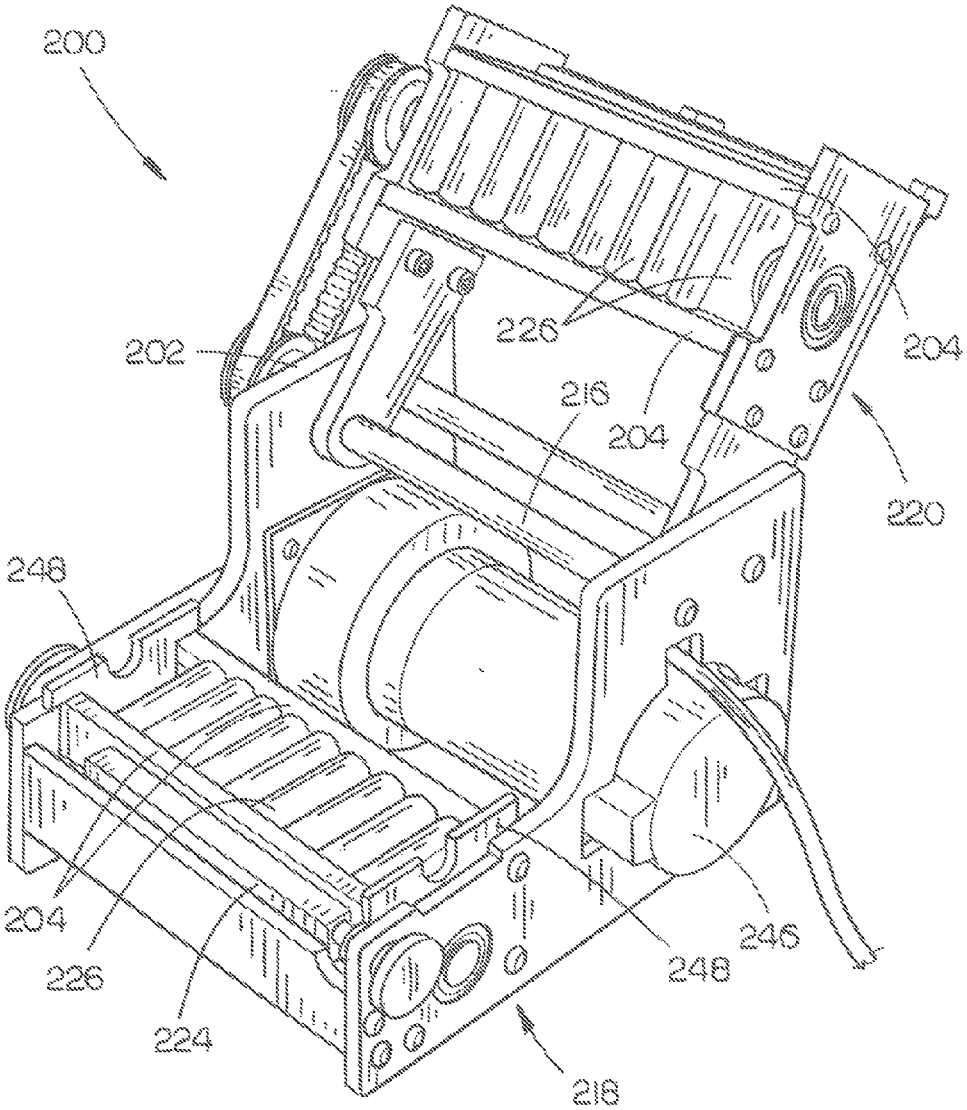
Figure 27:
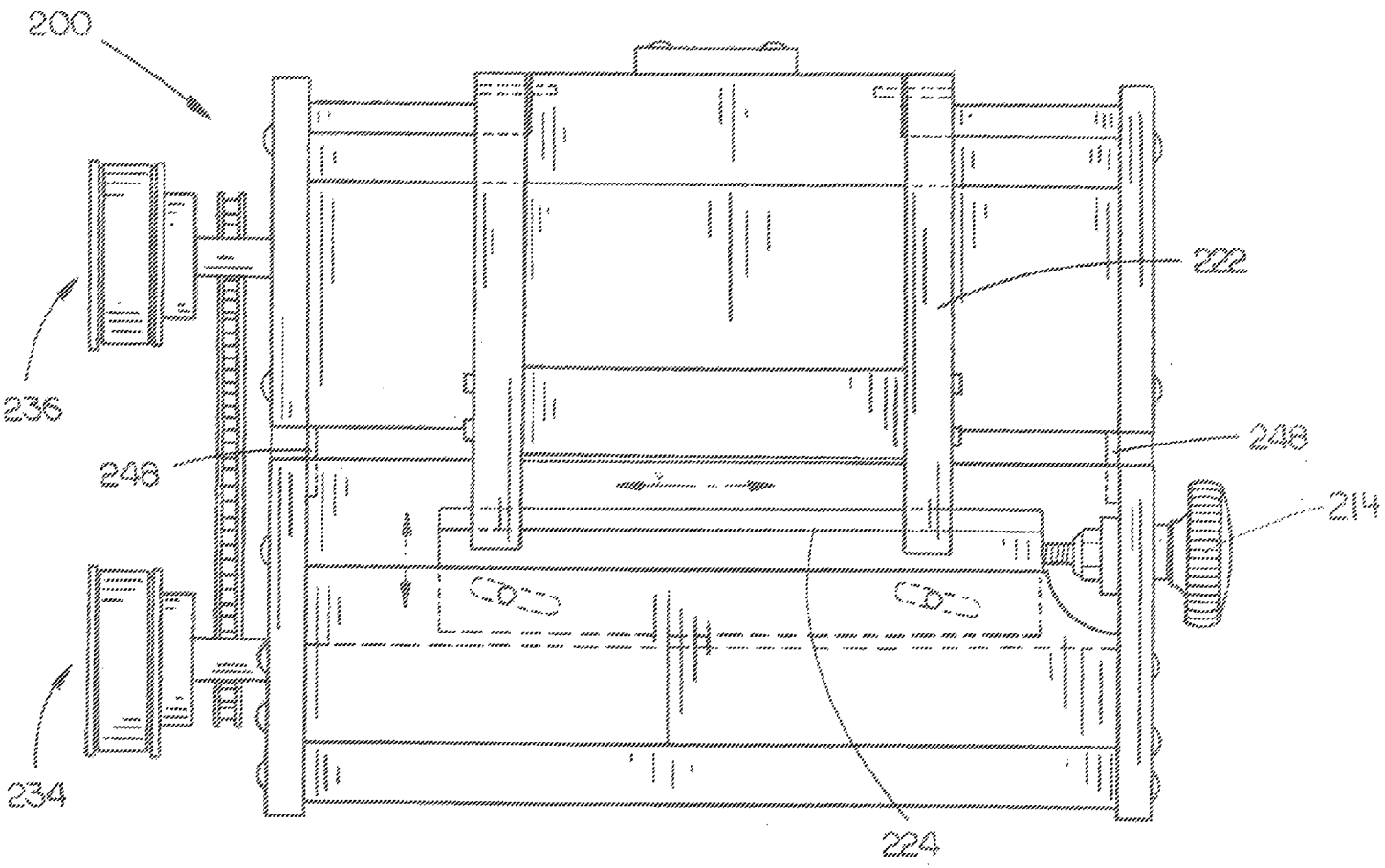
Figure 28A:
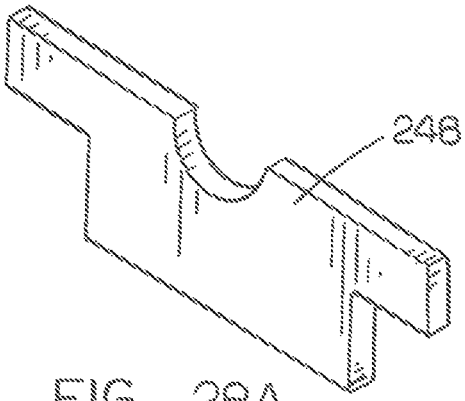
Figure 28B:
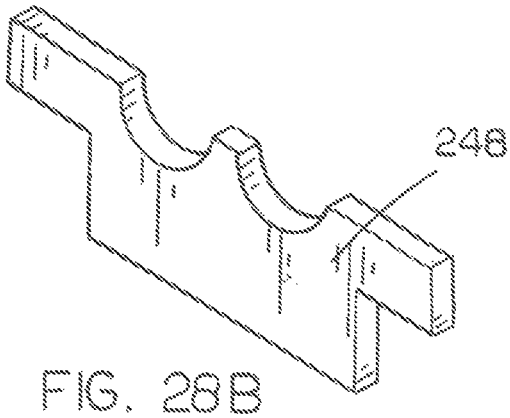
Figure 28C:
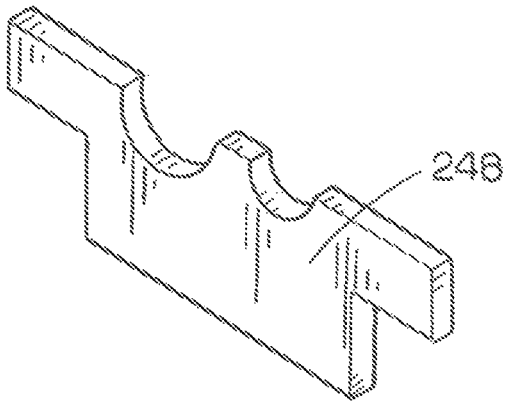
Figure 29:
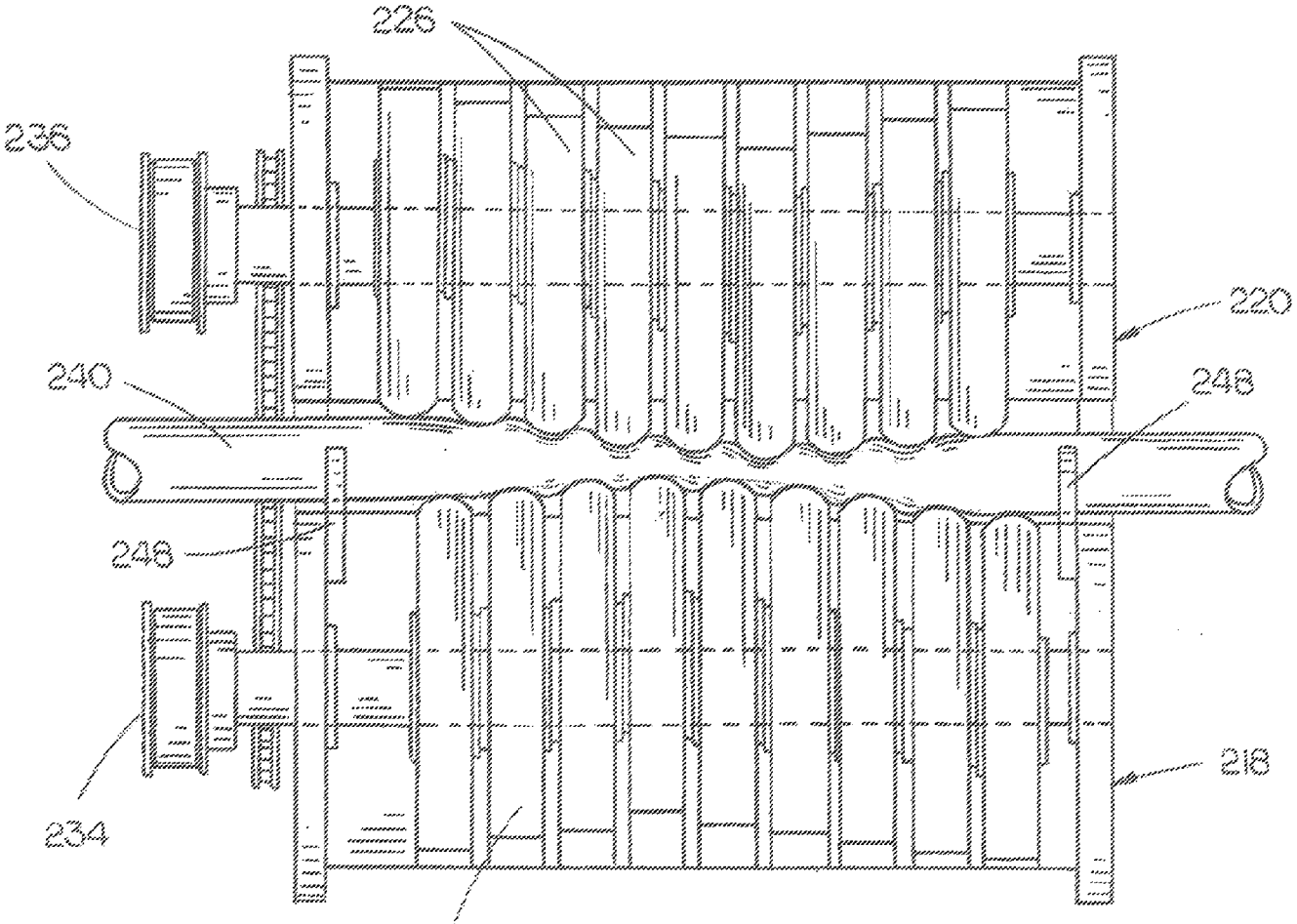
Figure 30:
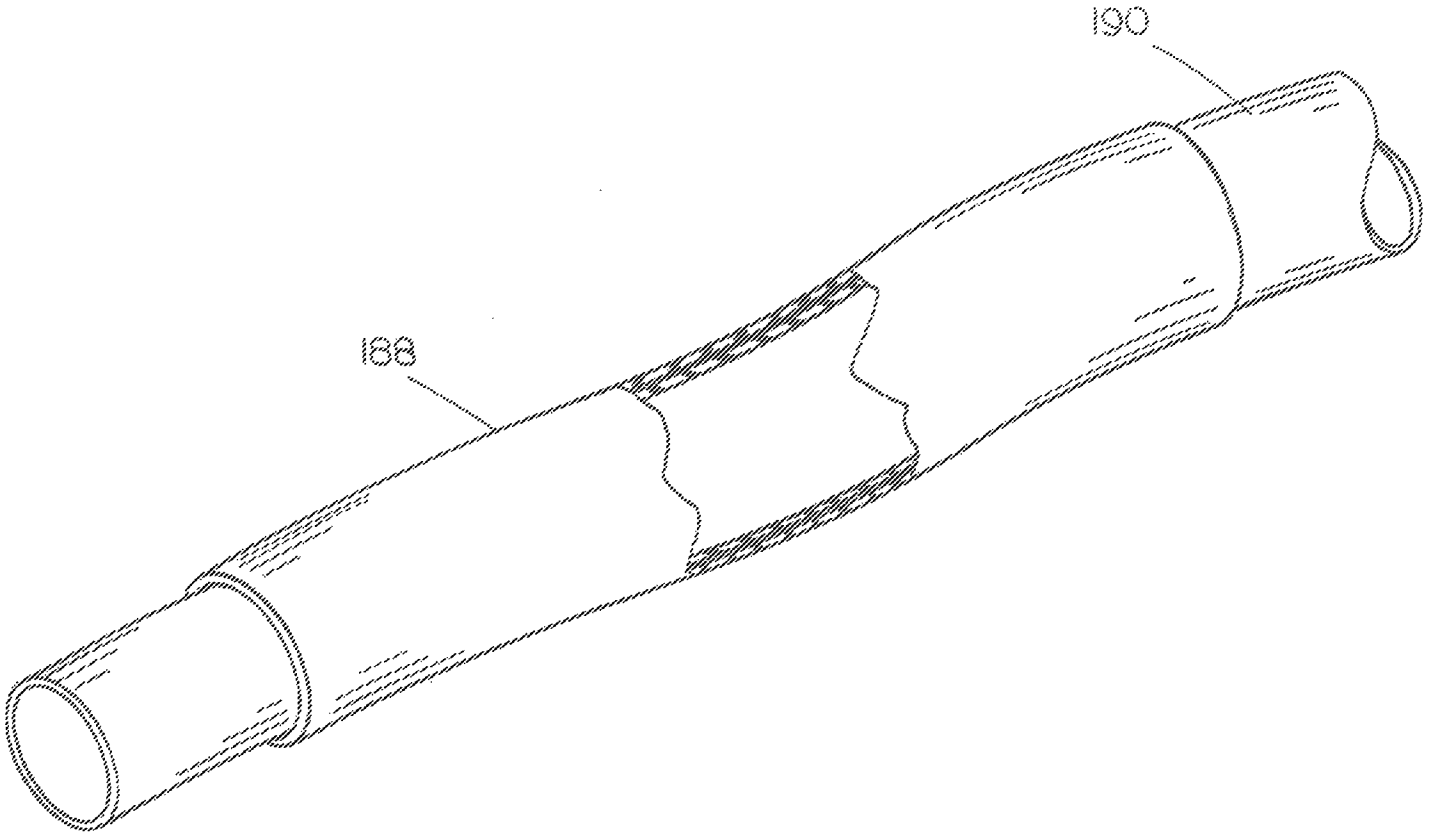
Figure 31:
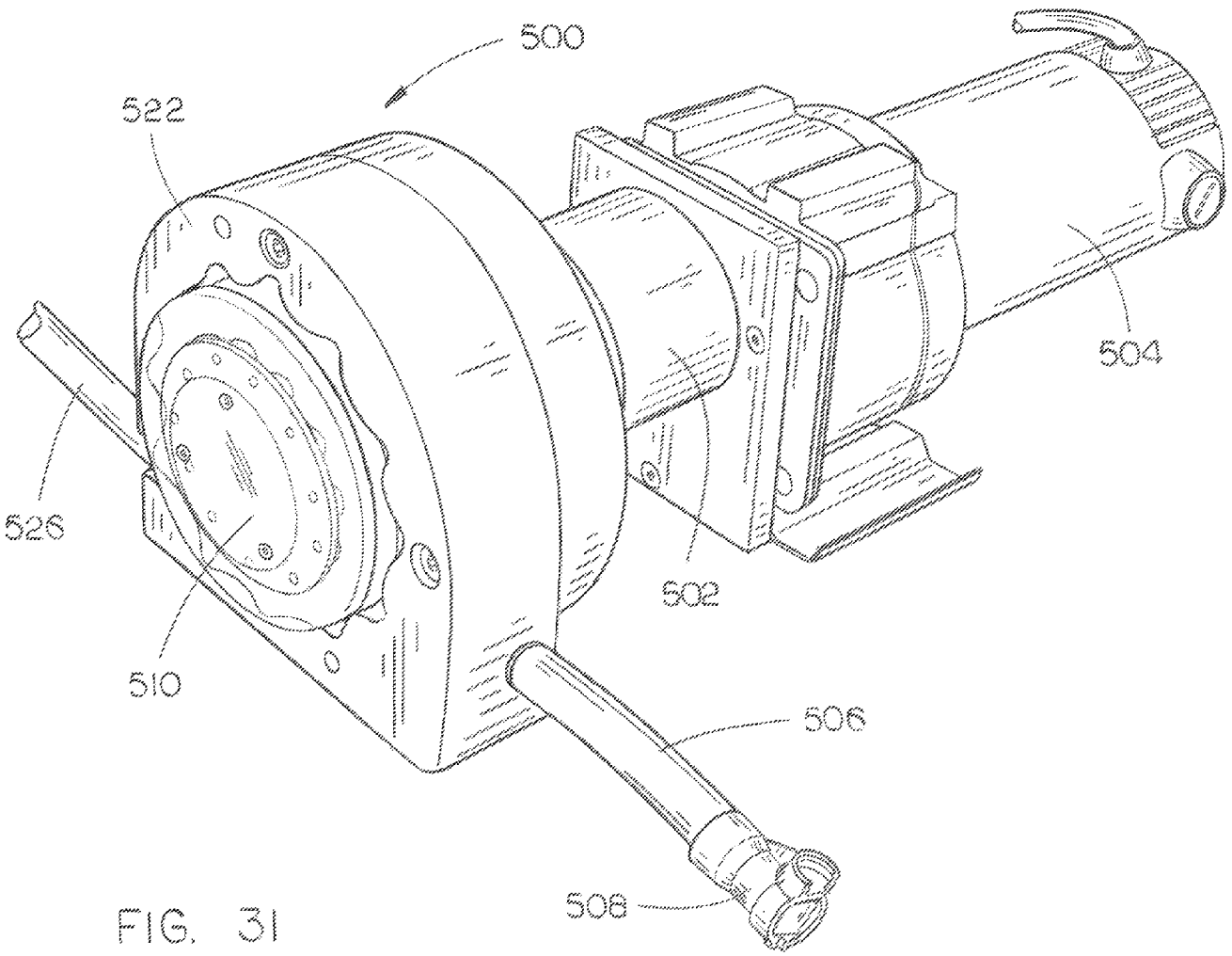
Figure 32:
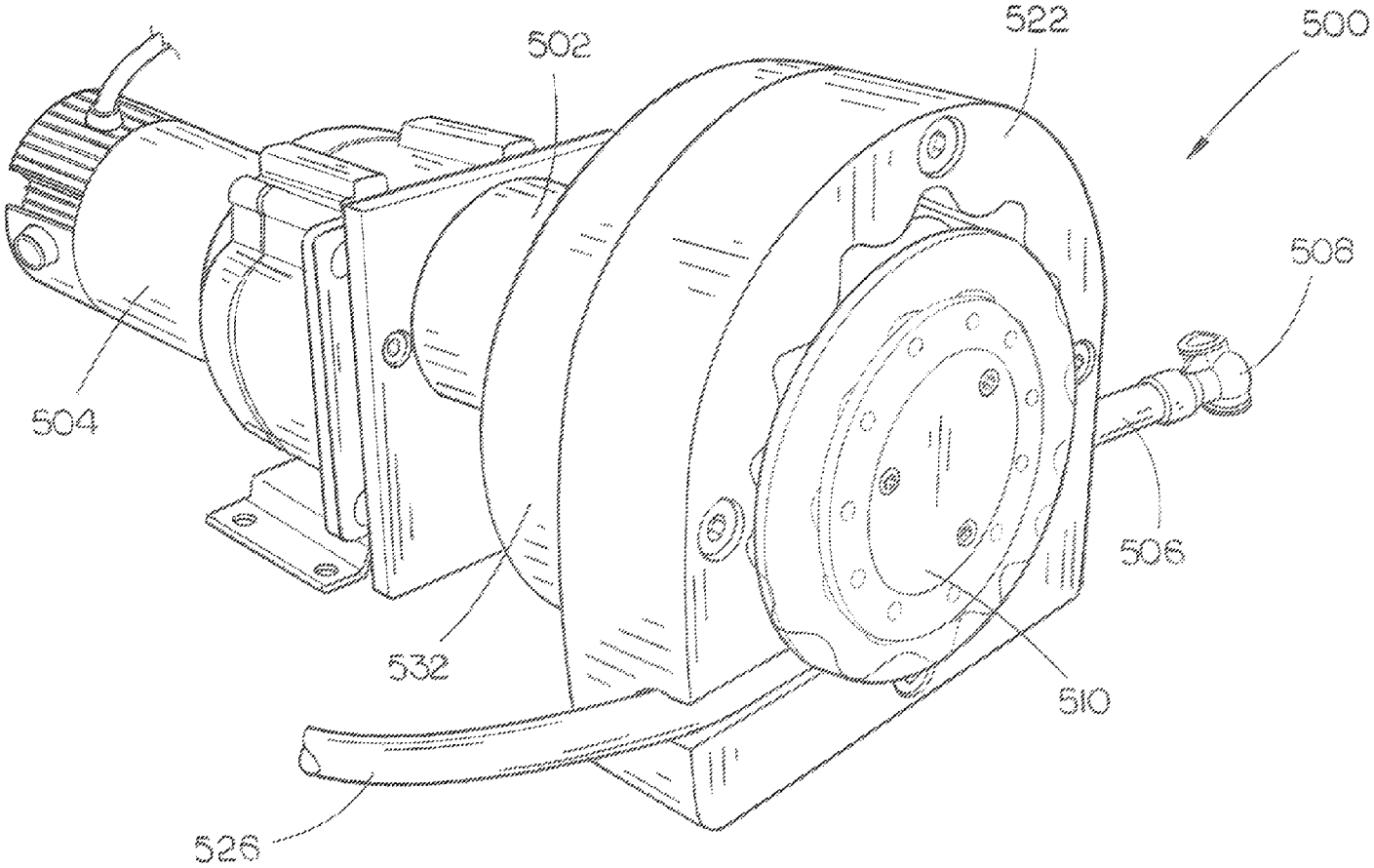
Figure 33:
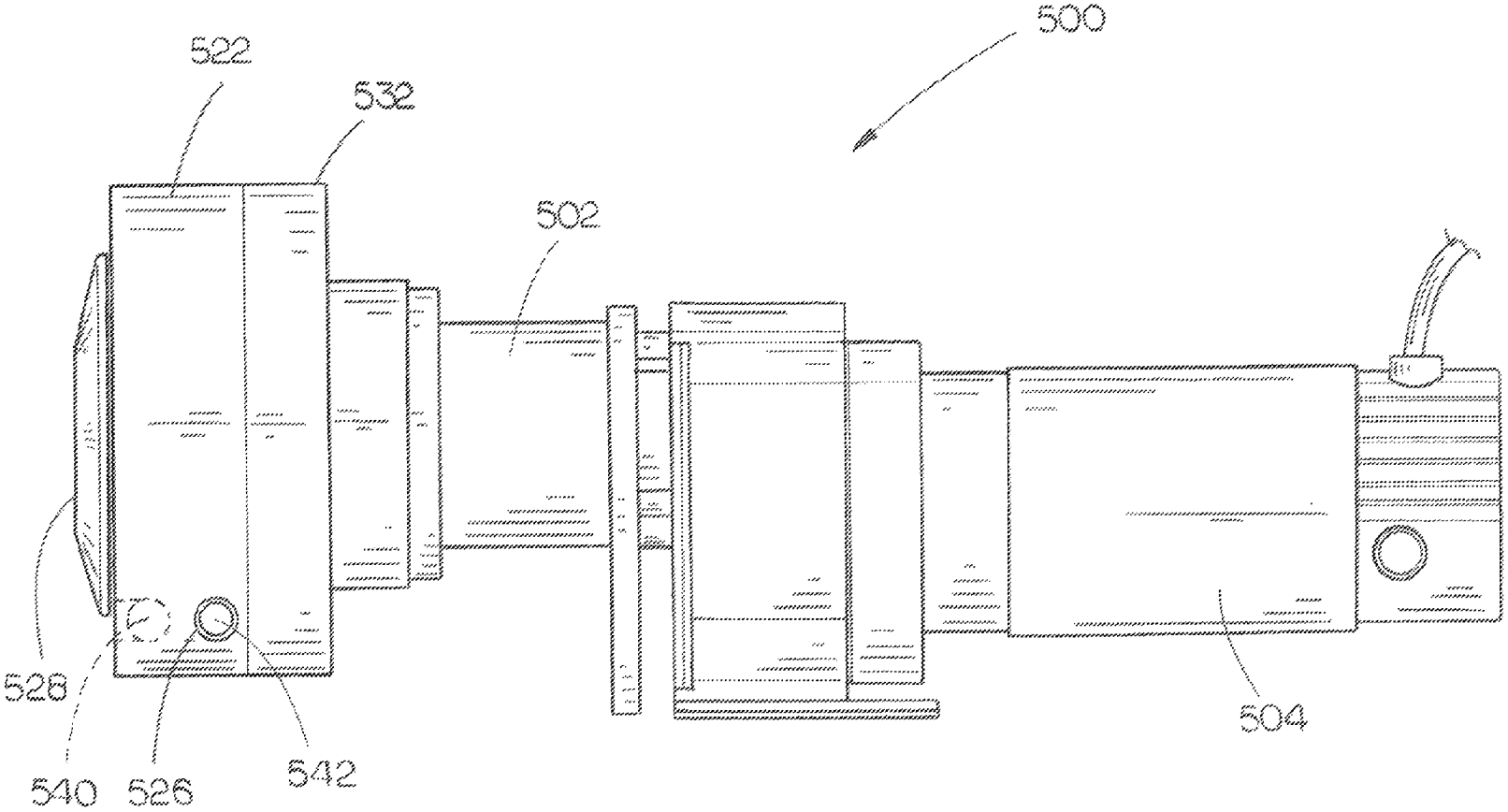
Figure 34:
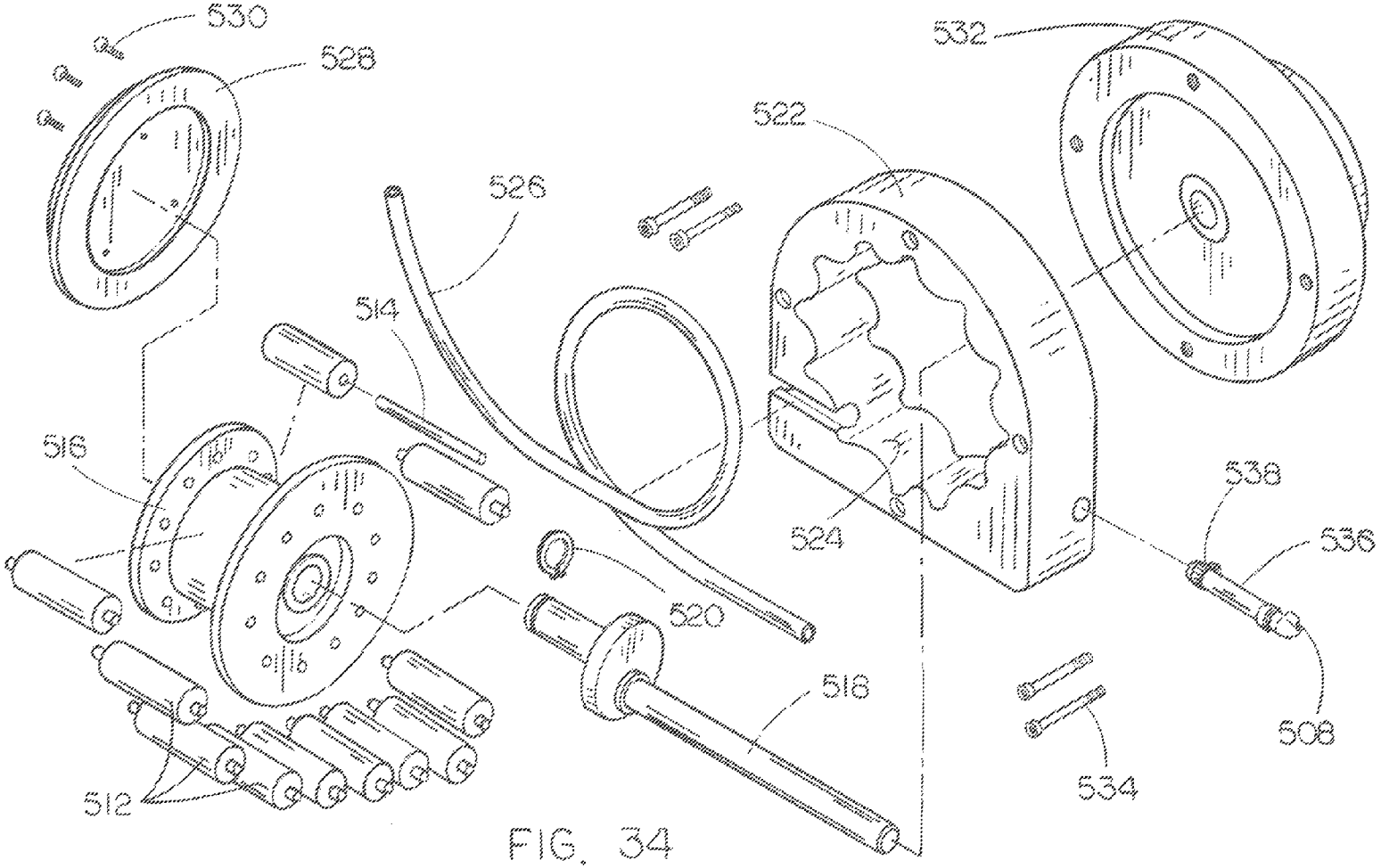
Figure 35:
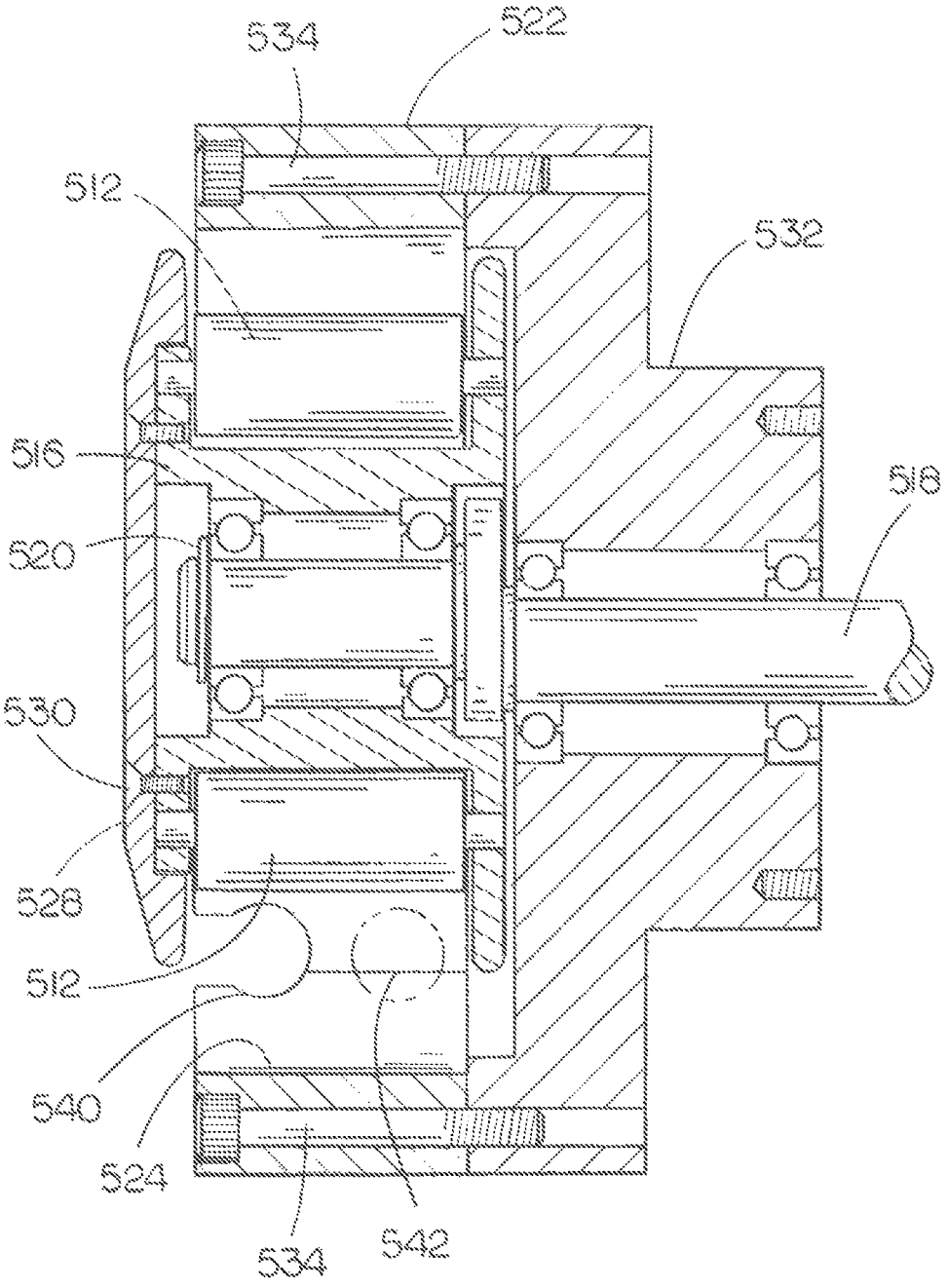
Figure 36:
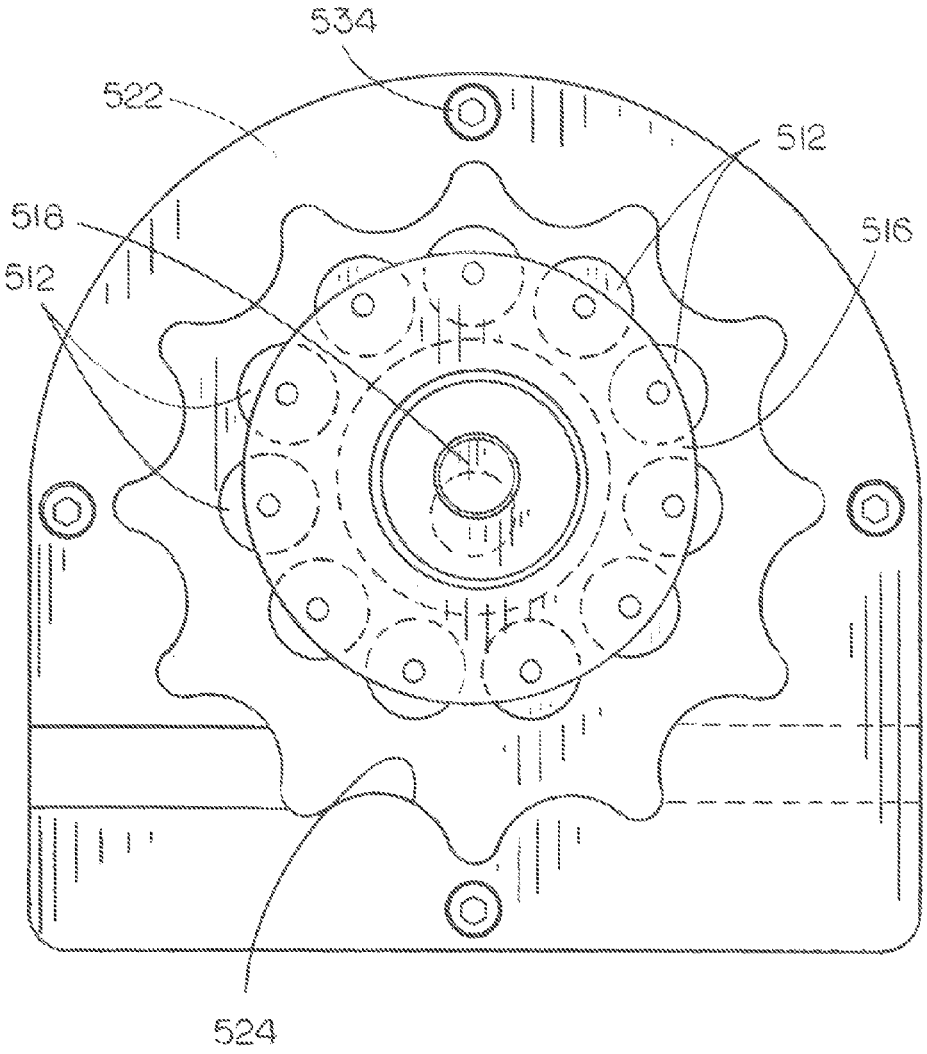
Figure 37A:
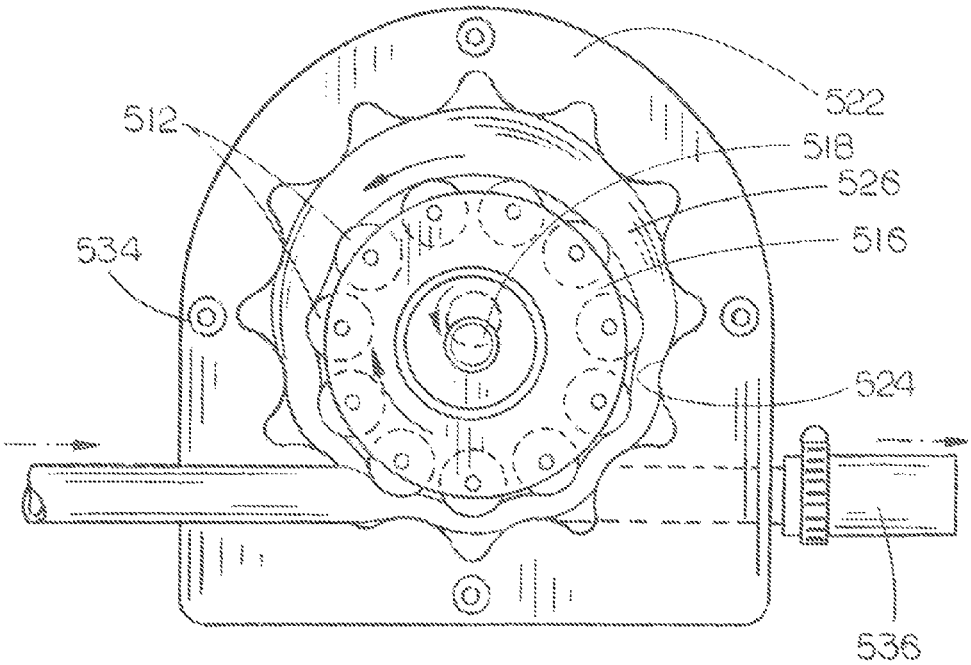
Figure 37B:
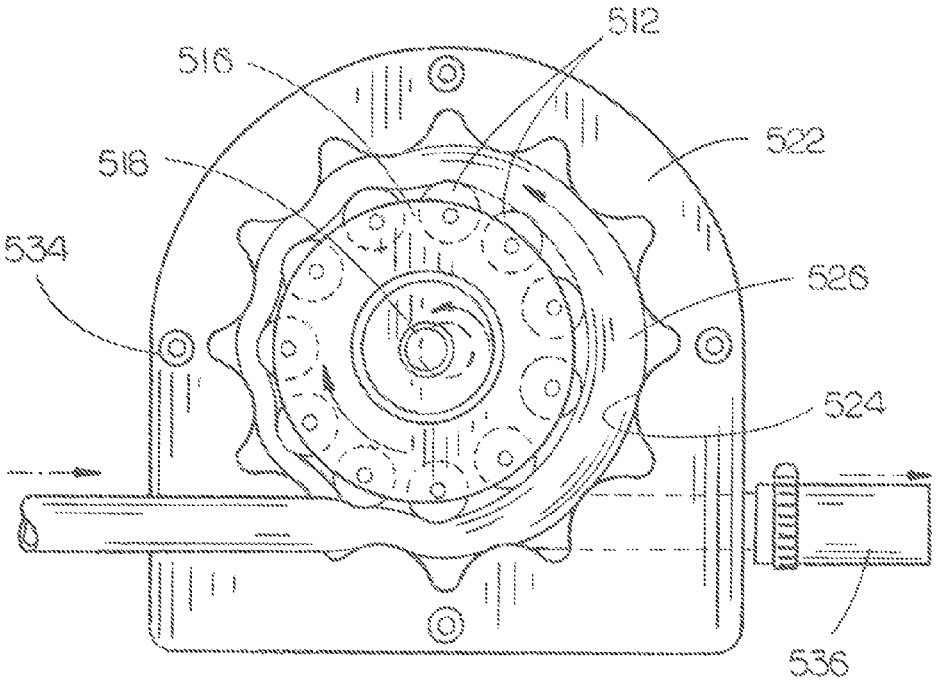
Figure 37C:
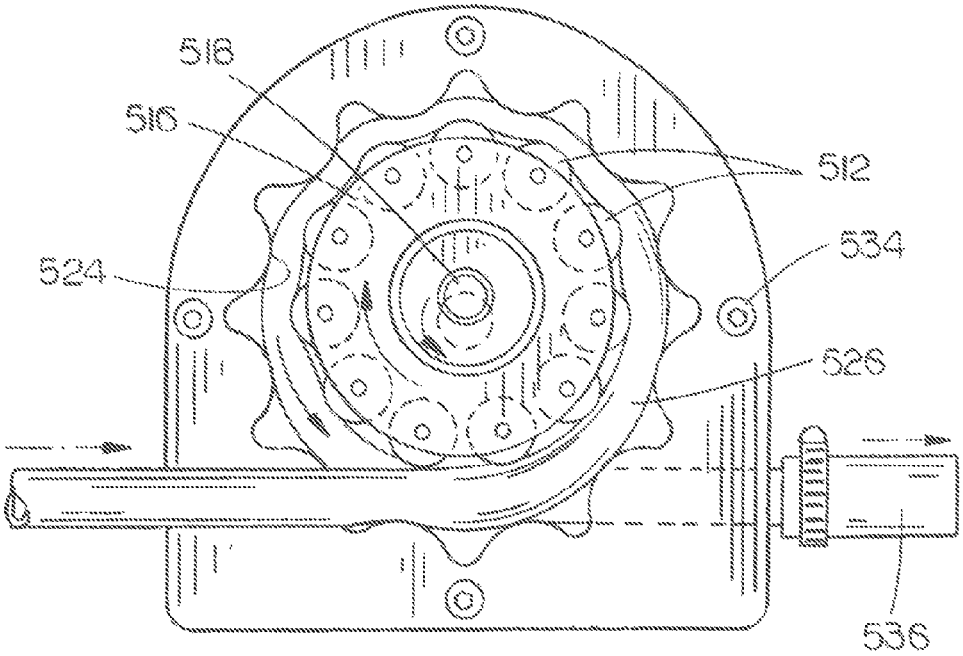
Figure 37D:
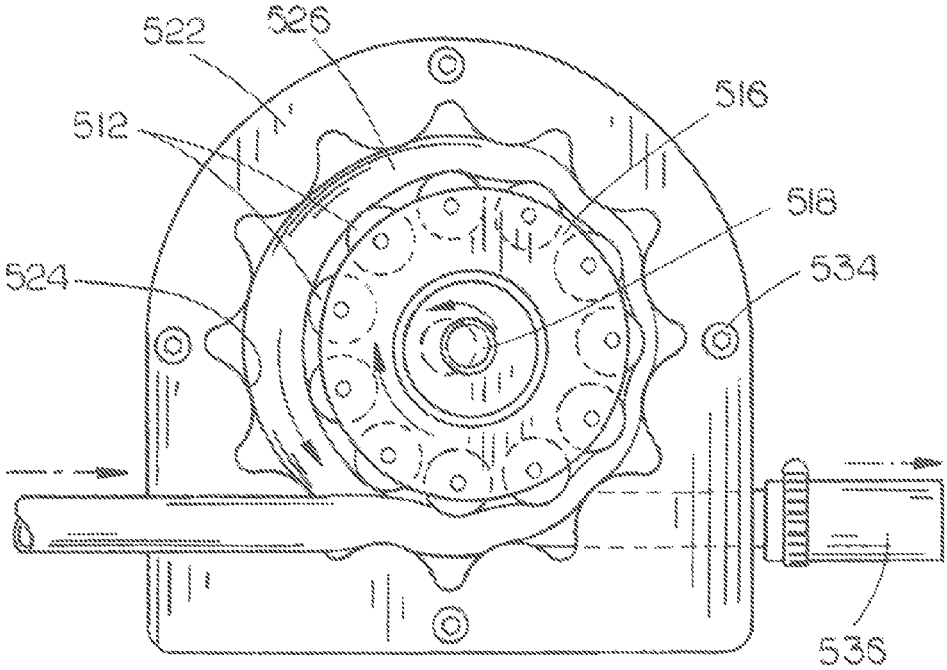
Figure 38:
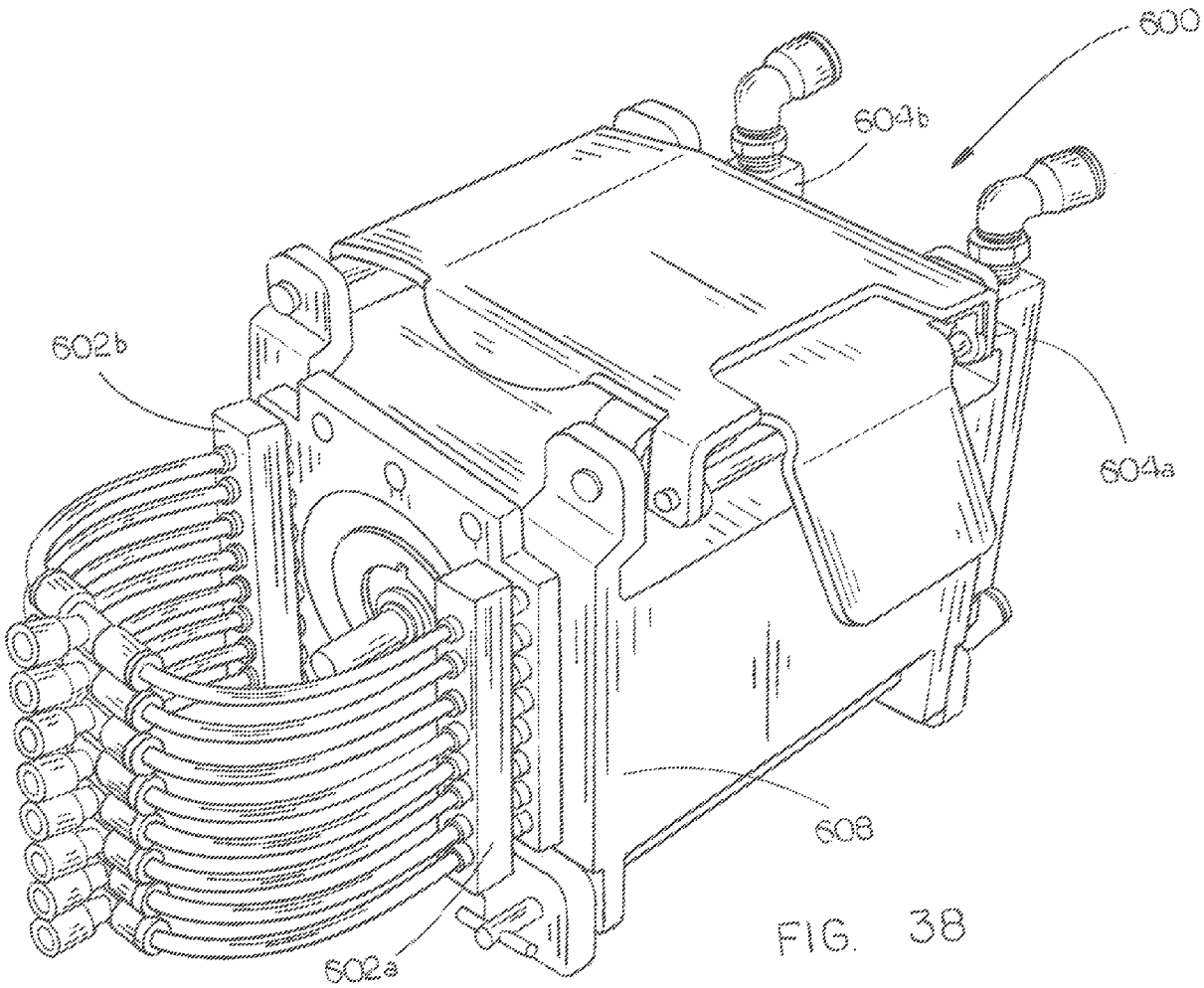
Figure 39:
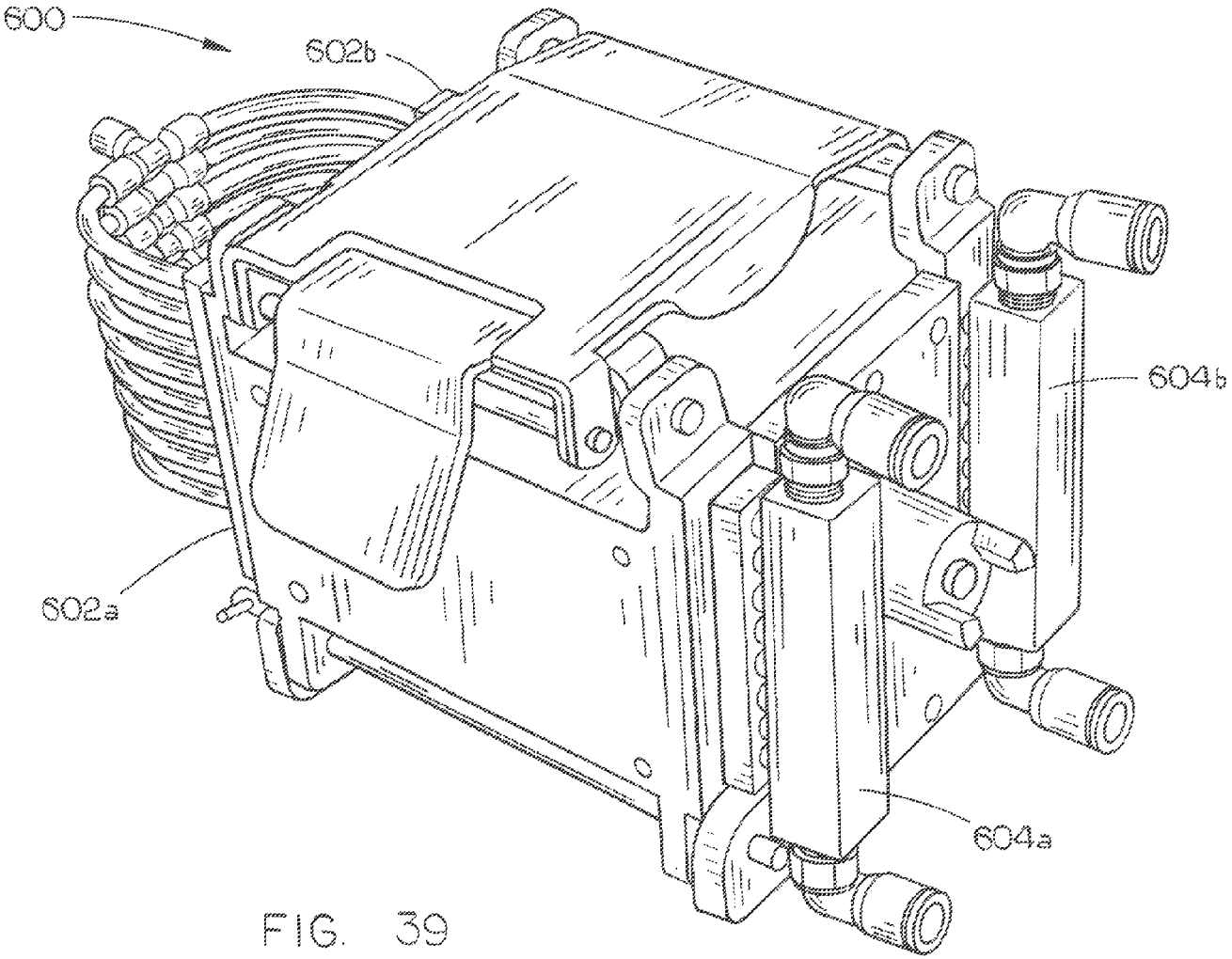
Figure 40:
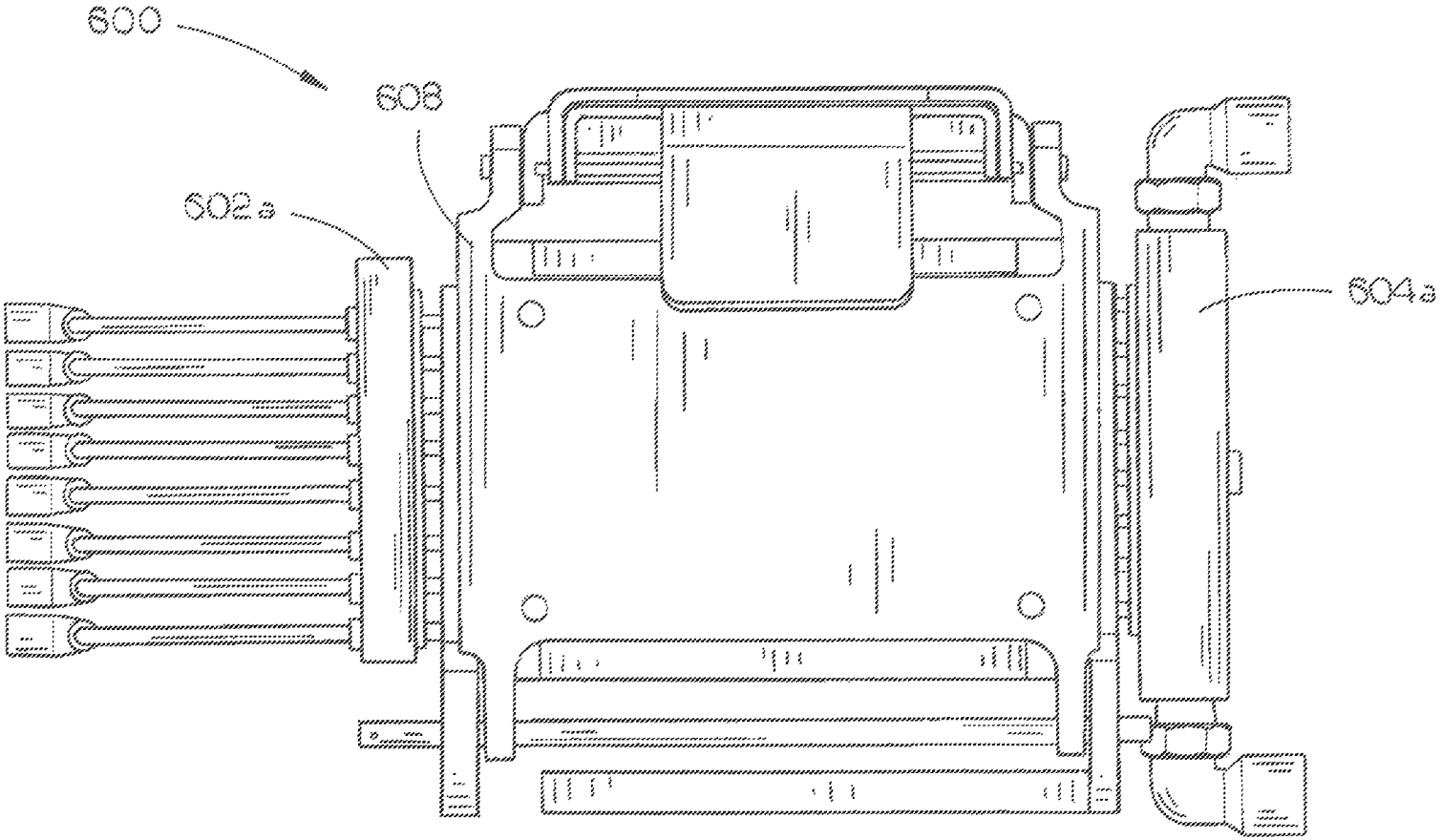
Figure 41:
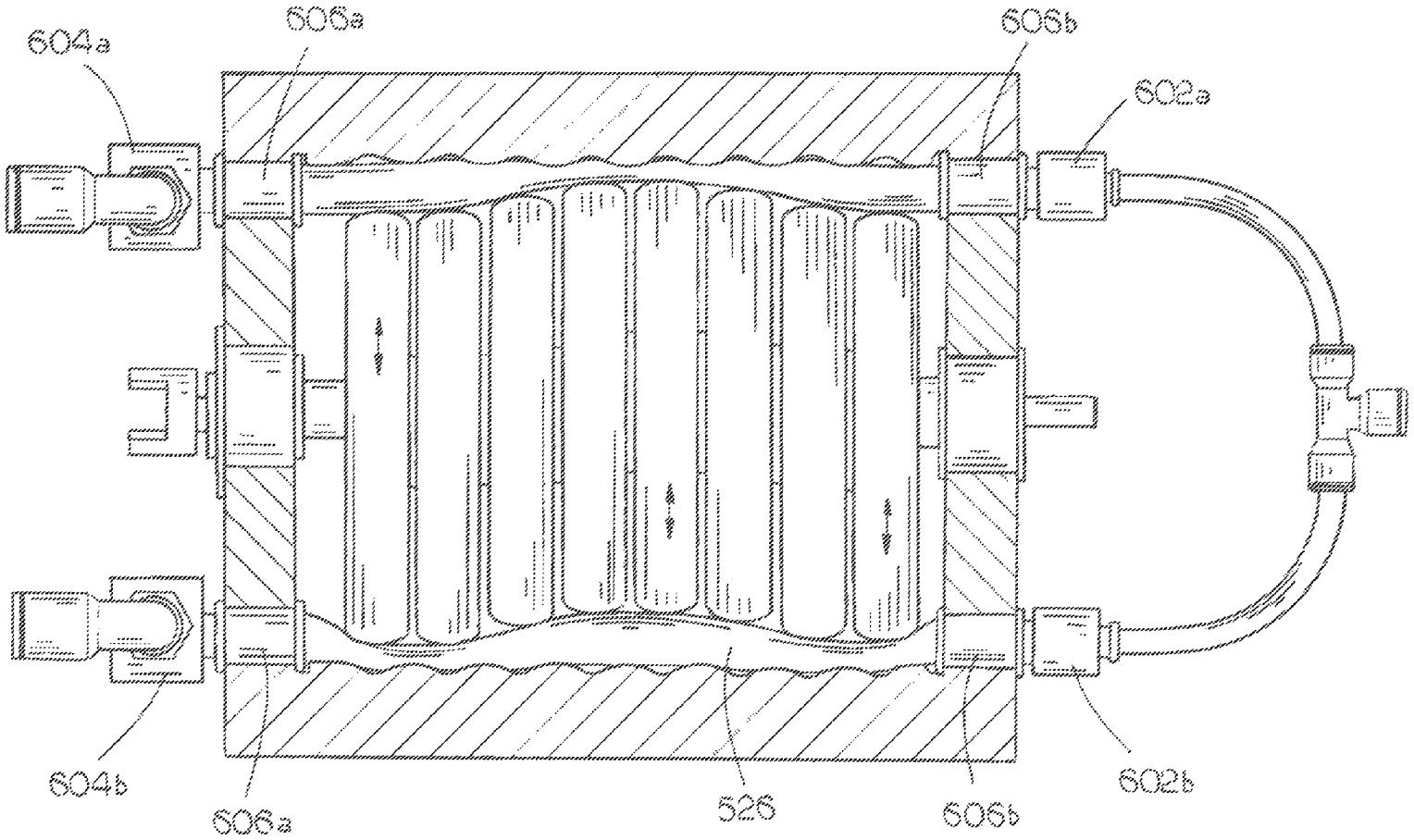
Figure 42:
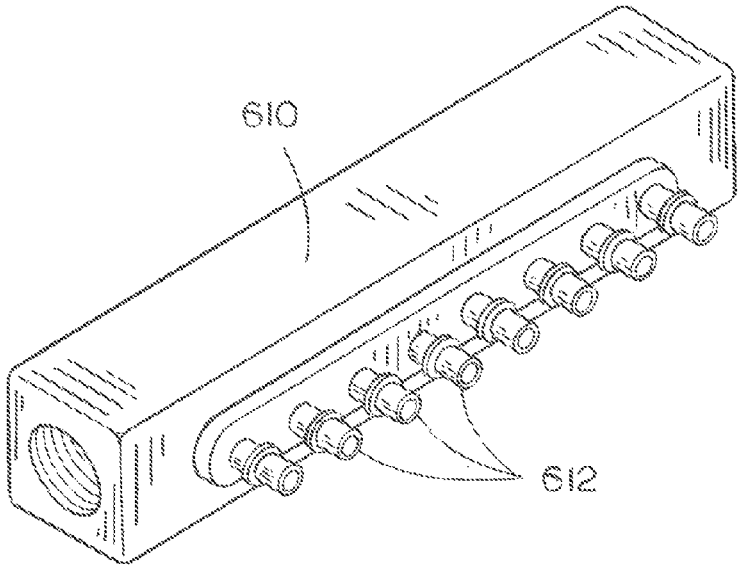
Figure 43:
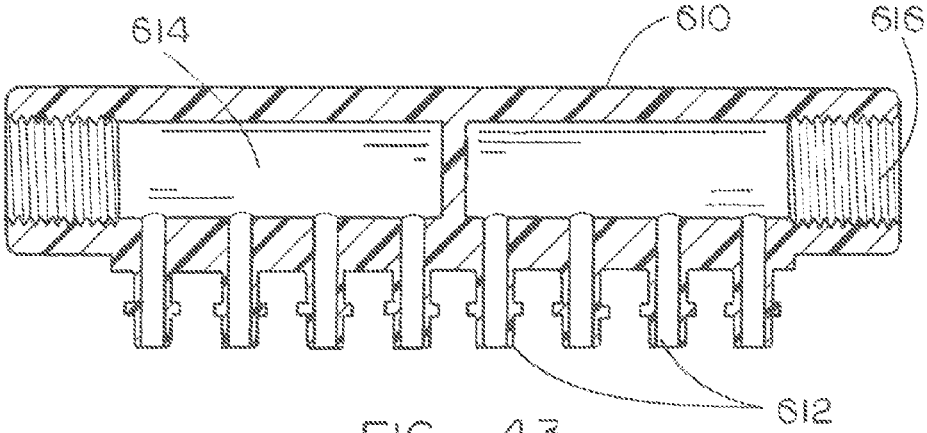
Figure 44:
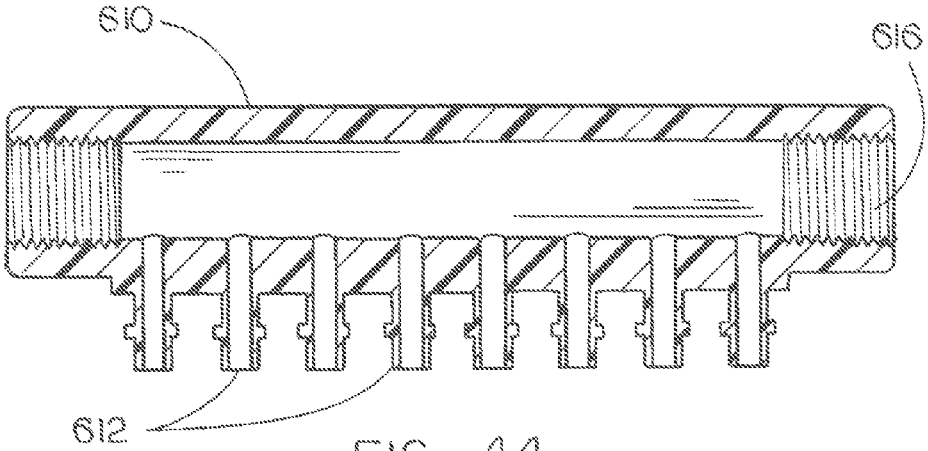
Figure 45:
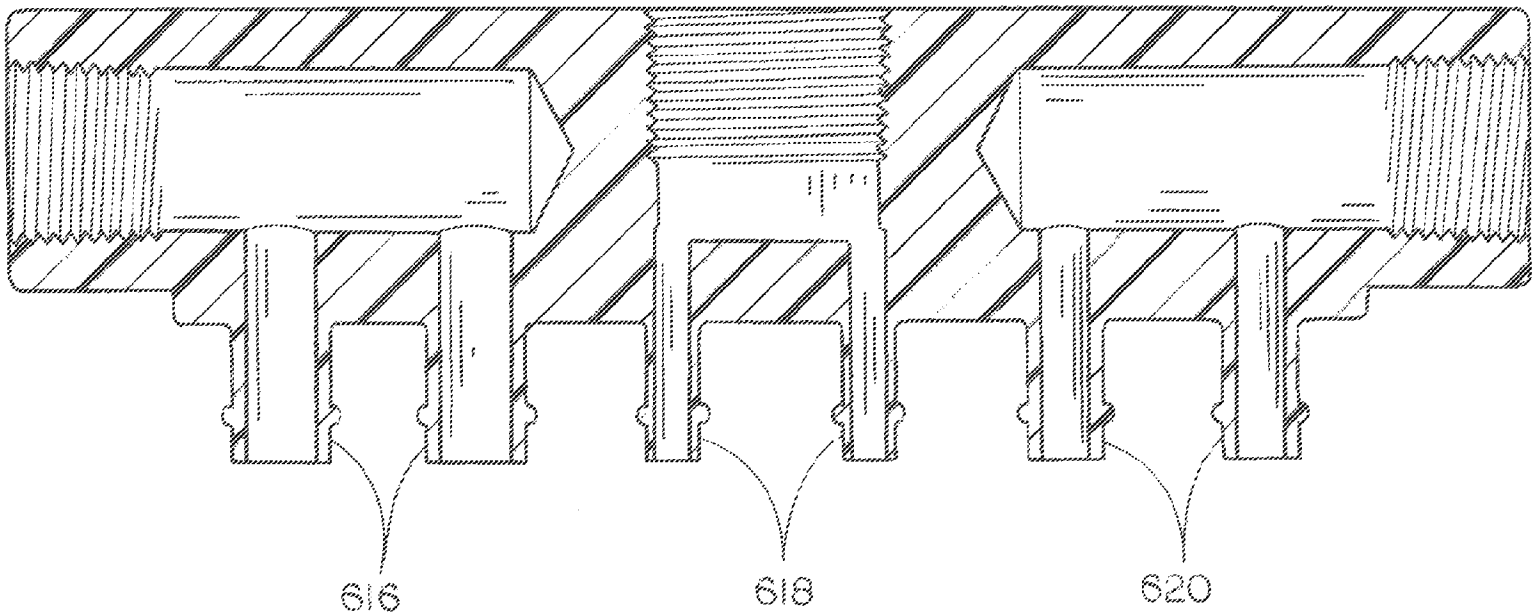
Figure 46:
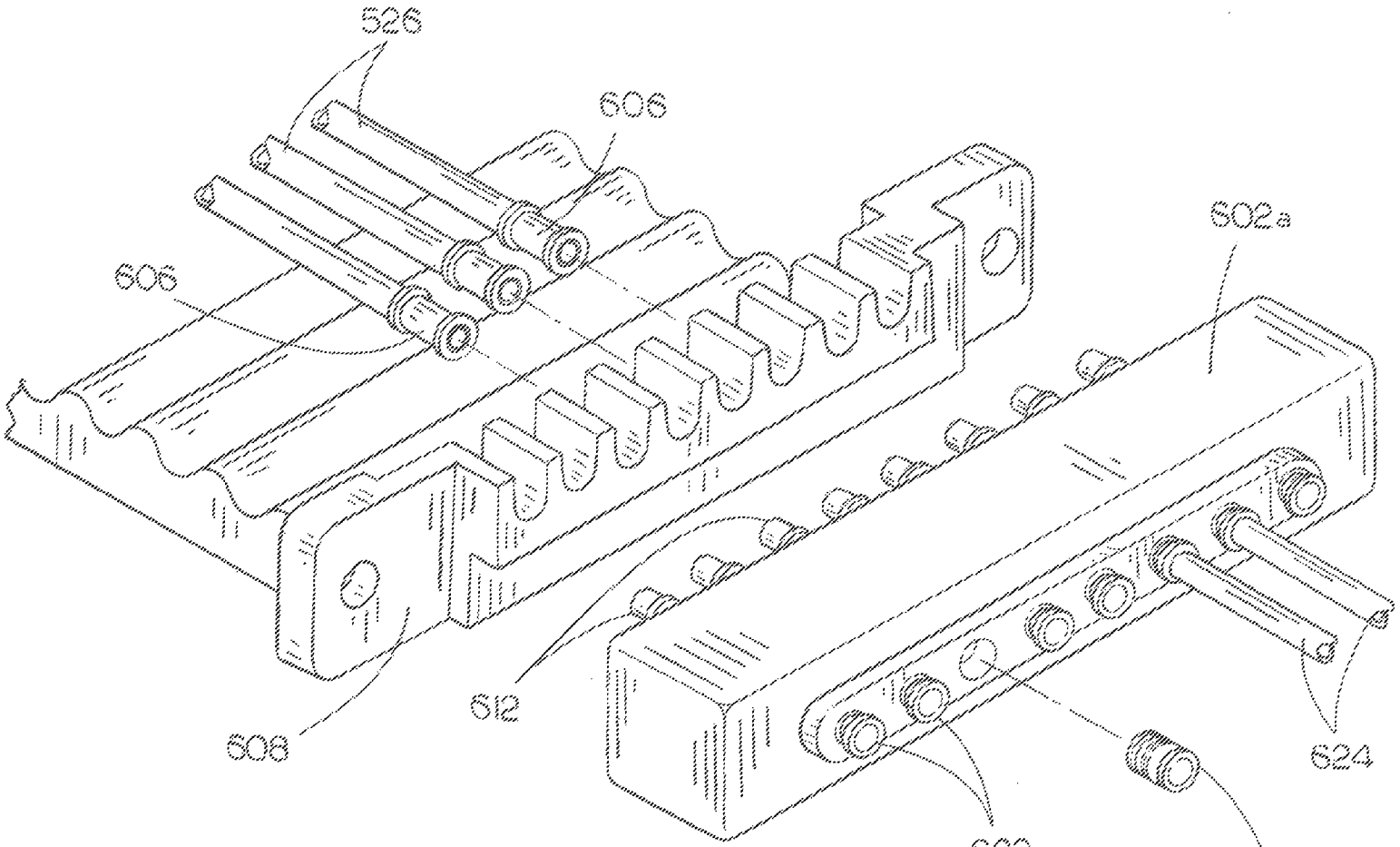
Figure 47:
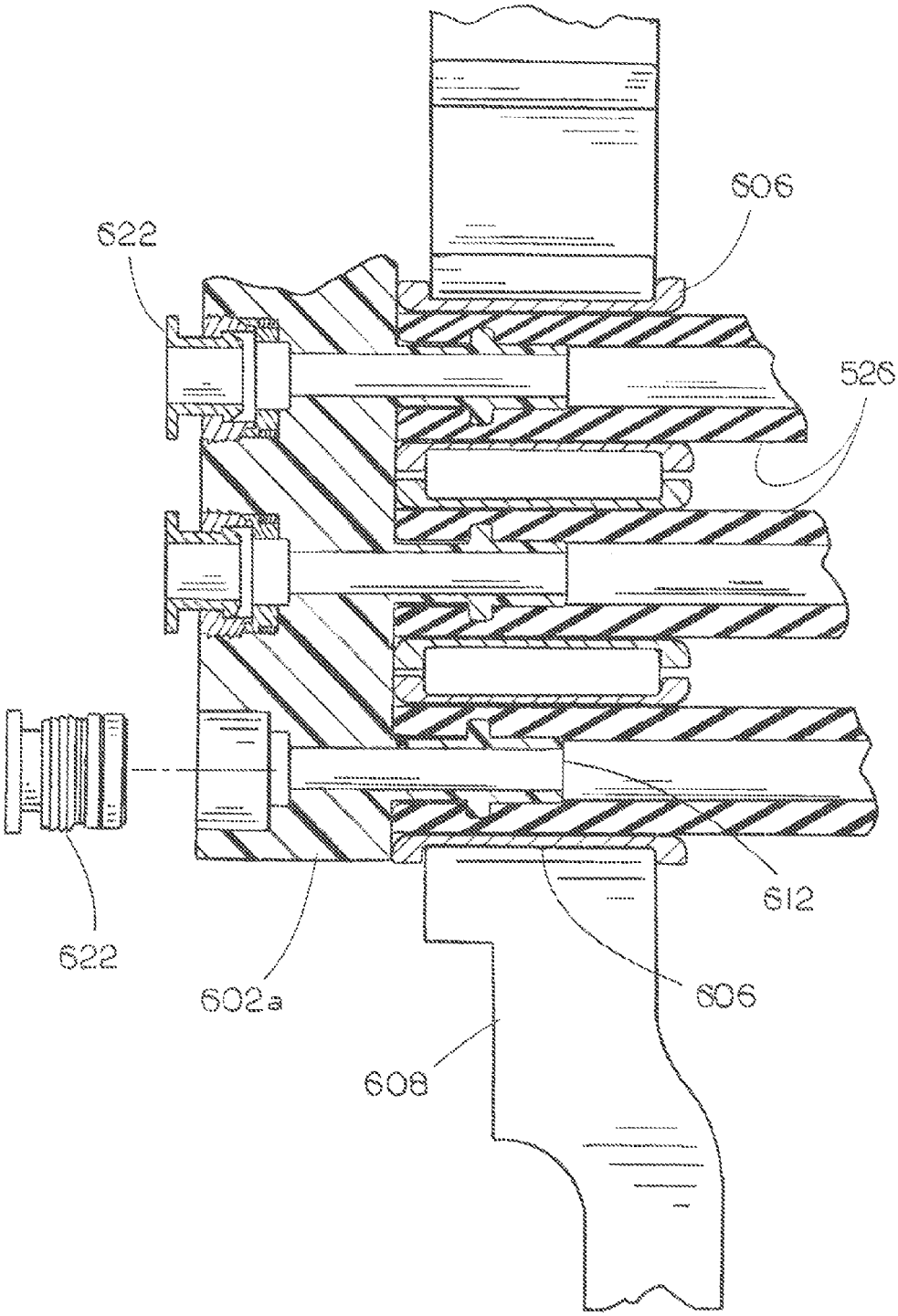
Figure 48:
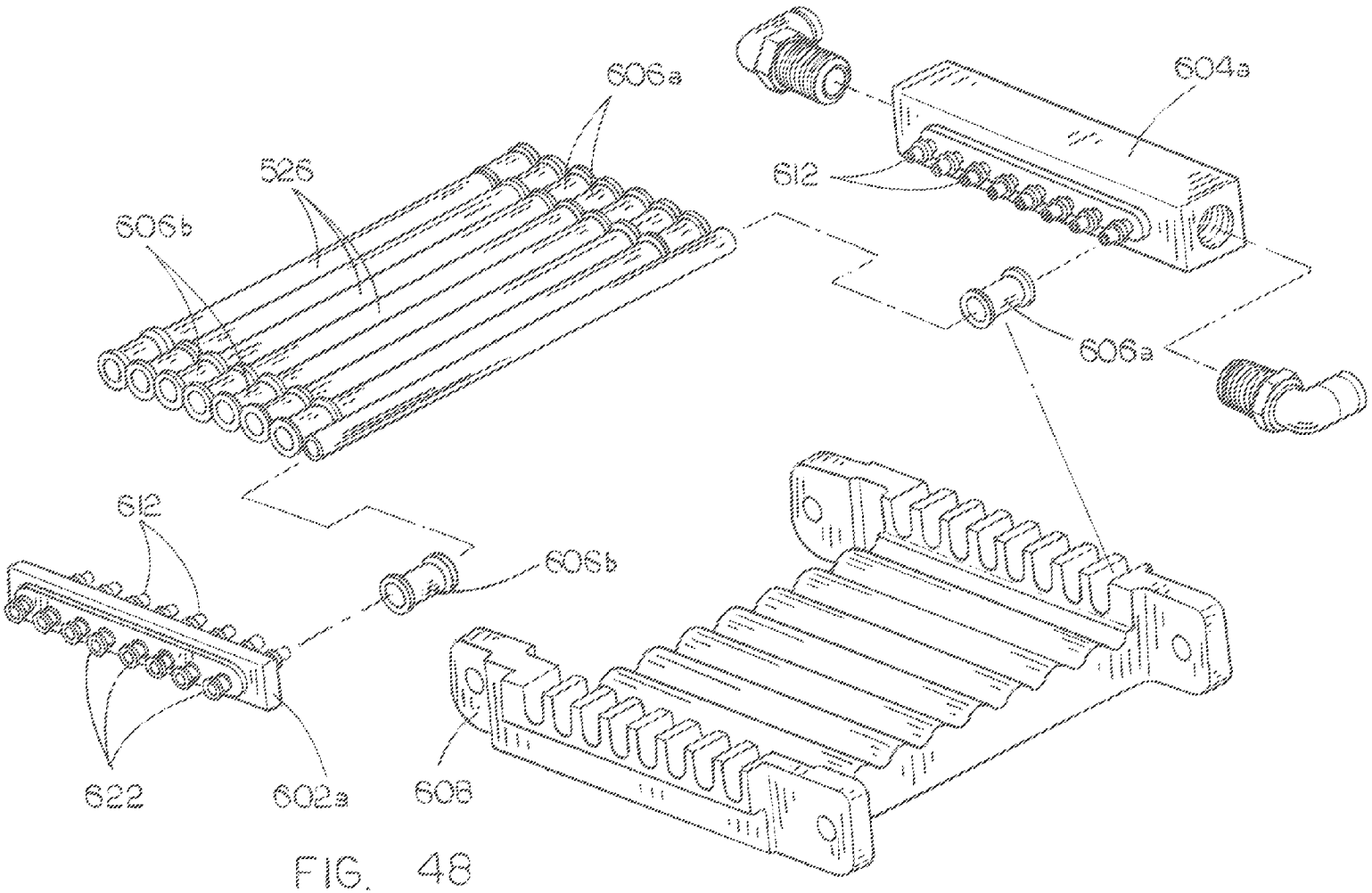
Figure 49:
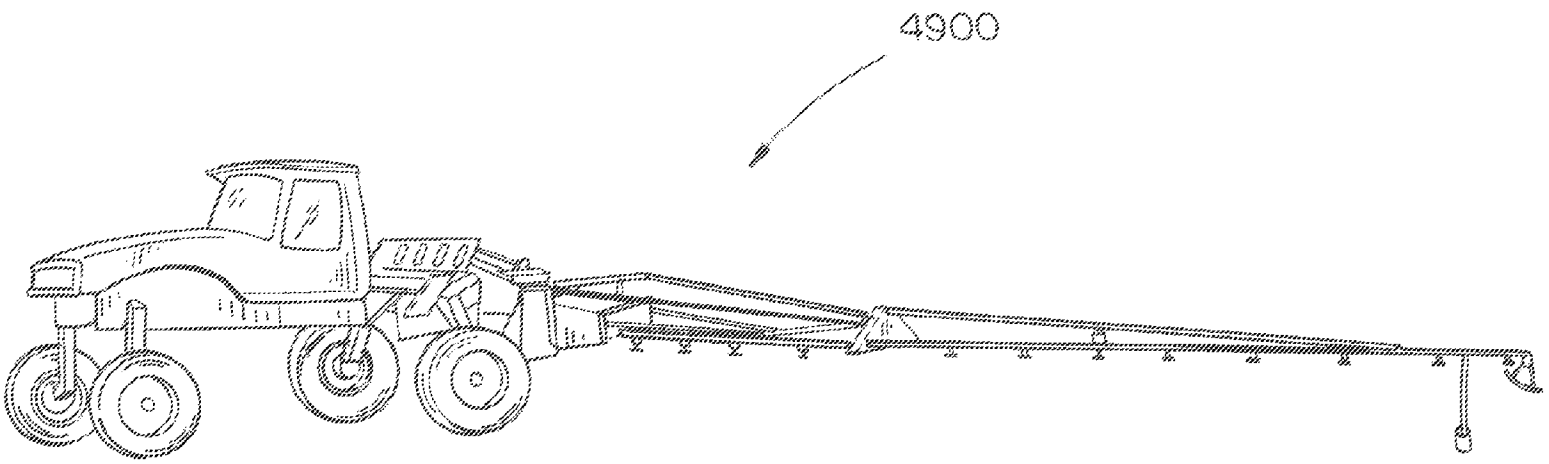
Figure 50:
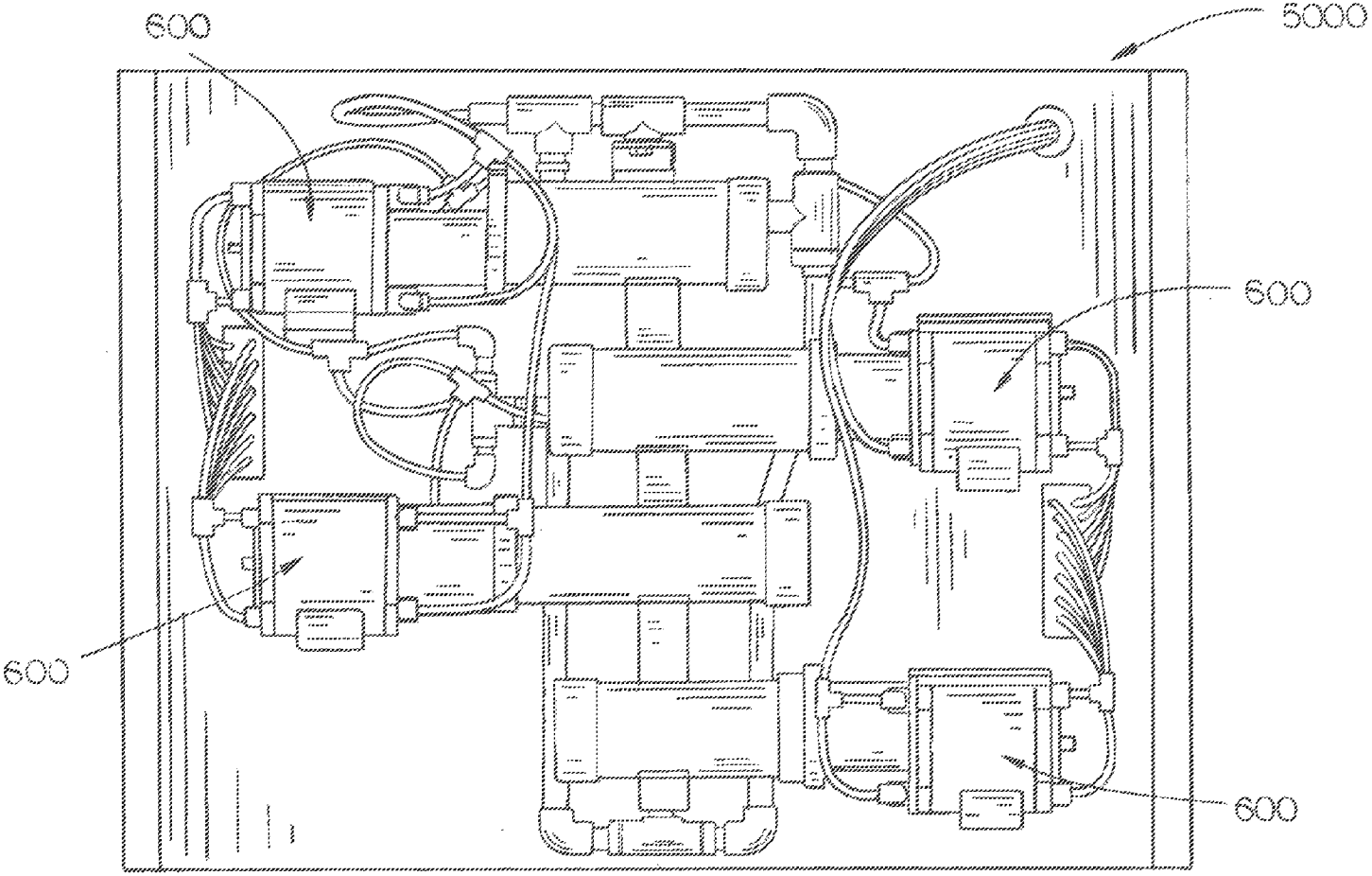

wherein it is illustrated that the invention accommodates transfer tubing of different diameters but substantially like wall thicknesses without altering the platens or pressure plates;

FIG. 24 is a perspective view of a bilateral peristaltic pump of the present invention illustrating a presently preferred opposing pressure plate configuration for increased improved pumping action in demanding industrial applications;

FIG. 25 is a perspective view of the bilateral peristaltic pump in an open position illustrating the drive assembly and opposing pressure plate configuration;

FIG. 26 is a perspective view of the bilateral peristaltic pump in an open position illustrating the transfer tube re-sizing collars and opposing pressure plate configuration of a presently preferred embodiment;

FIG. 27 is an end view of the bilateral peristaltic pump illustrating the adjustable latch assembly;

FIGS. 28A, 28B, and 28C are perspective views of various sample configurations of transfer tube re-sizing collars for allowing different sizes and numbers of transfer tubes to be accommodated;

FIG. 29 is a partial cross-sectional plan view of the bilateral peristaltic pump in operation illustrating the operation of the opposing pressure plates and the transfer tube;

FIG. 30 illustrates a pump contamination prevention embodiment of the present invention;

FIG. 31 is a perspective view of direct current motor driven rotary embodiment of the present invention illustrating the pump, motor and pump drive assembly;

FIG. 32 is a perspective view of direct current motor driven rotary embodiment of the present invention illustrating the rotary and fixed platens;

FIG. 33 is an elevational view of a rotary embodiment of the present invention;

FIG. 34 is an exploded perspective view of the rotary pump of the present invention;

FIG. 35 is a side elevation cross-sectional view of a rotary pump embodiment of the present invention;

FIG. 36 is a front elevation cross-sectional view of a rotary pump embodiment of the present invention;

FIGS. 37A, 37B, 37C, and 37D are front elevation cross-sectional views of a rotary pump embodiment of the present invention in operation;

FIG. 38 is a perspective view of an output manifold on a twin action peristaltic pump of the present invention;

FIG. 39 is a perspective view of an input manifold on a twin action peristaltic pump of the present invention;

FIG. 40 is an elevational side view of a quick connect input and output manifold of an embodiment of the present invention;

FIG. 41 is a top plan cross-sectional view of a quick connect manifold on a twin action peristaltic pump of the present invention;

FIG. 42 is a perspective view of the quick connect input and output manifold of an embodiment of the present invention;

FIG. 43 is a cross-sectional view of a bifurcated input and output manifold of an embodiment of the present invention;

FIG. 44 is a cross-sectional view of a single path input and output manifold of an embodiment of the present invention;

FIG. 45 is a cross-sectional view of an input mixing manifold of an embodiment of the present invention;

FIG. 46 is a perspective view of a quick connect manifold of the present invention illustrating a pumping tube securement assembly, pump tubes, platen, and manifold with quick tubing interconnections;

FIG. 47 is a cross-section of the pumping tube securement assembly, pumping tubes, manifold and quick tube interconnects;

FIG. 48 is a perspective exploded view of a mono-lateral manifold assembly of the present invention;

FIG. 49 is a wide-boom multi-head crop sprayer utilizing at least one peristaltic pump of the present invention; and FIG. 50 is a top plan view of a multi-peristaltic pump manifold embodiment of the present invention.

DETAILED DESCRIPTION

Figure 1:
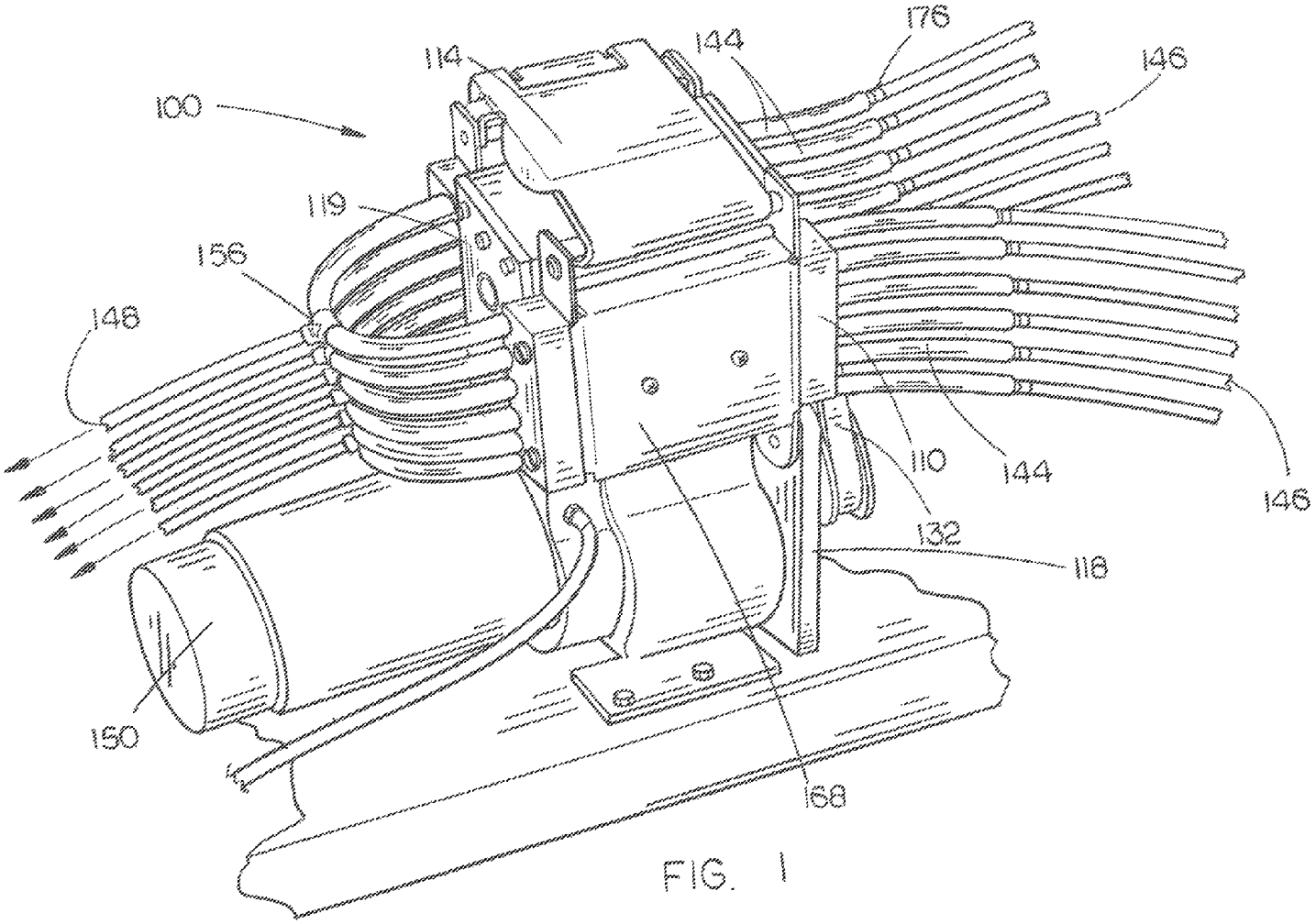
FIG. 1 is a perspective view of a multiple output mono-lateral peristaltic pump of the present invention illustrating a presently preferred dual sequenced pumping configuration for reducing output spurting and increasing pumping action.

The present invention may be generally configured in both mono-lateral (FIG. 1) and bilateral (FIG. 24) embodiments. It will be appreciated from the drawings and the description herein that many alternative embodiments are contemplated. FIG. 1 illustrates a mono-lateral peristaltic pump 100 of the present invention. The mono-lateral pump 100 includes a pump frame assembly (FIG. 2), which includes a plurality of pressure plates 106 (FIGS. 2, 5, 7 & 9) operatively housed in the frame (FIG. 2) in spaced apart parallel arrangement by pressure plate guides 104 (FIG. 8). The pump frame assembly includes a top plate 170, a bottom plate 172, and a pair of side plates 118 and 119 (FIG. 8). The top and bottom plates (170, 172) are retained in a dado (shown) or rabbet (not shown) 174 or other suitable joint (FIG. 8). It will be appreciated that the pressure plate guides 104 not only act as bearings and guides but also set the spacing between pressure plates 106 (0.5 to 5.0 mm is presently preferred).

Figure 7:
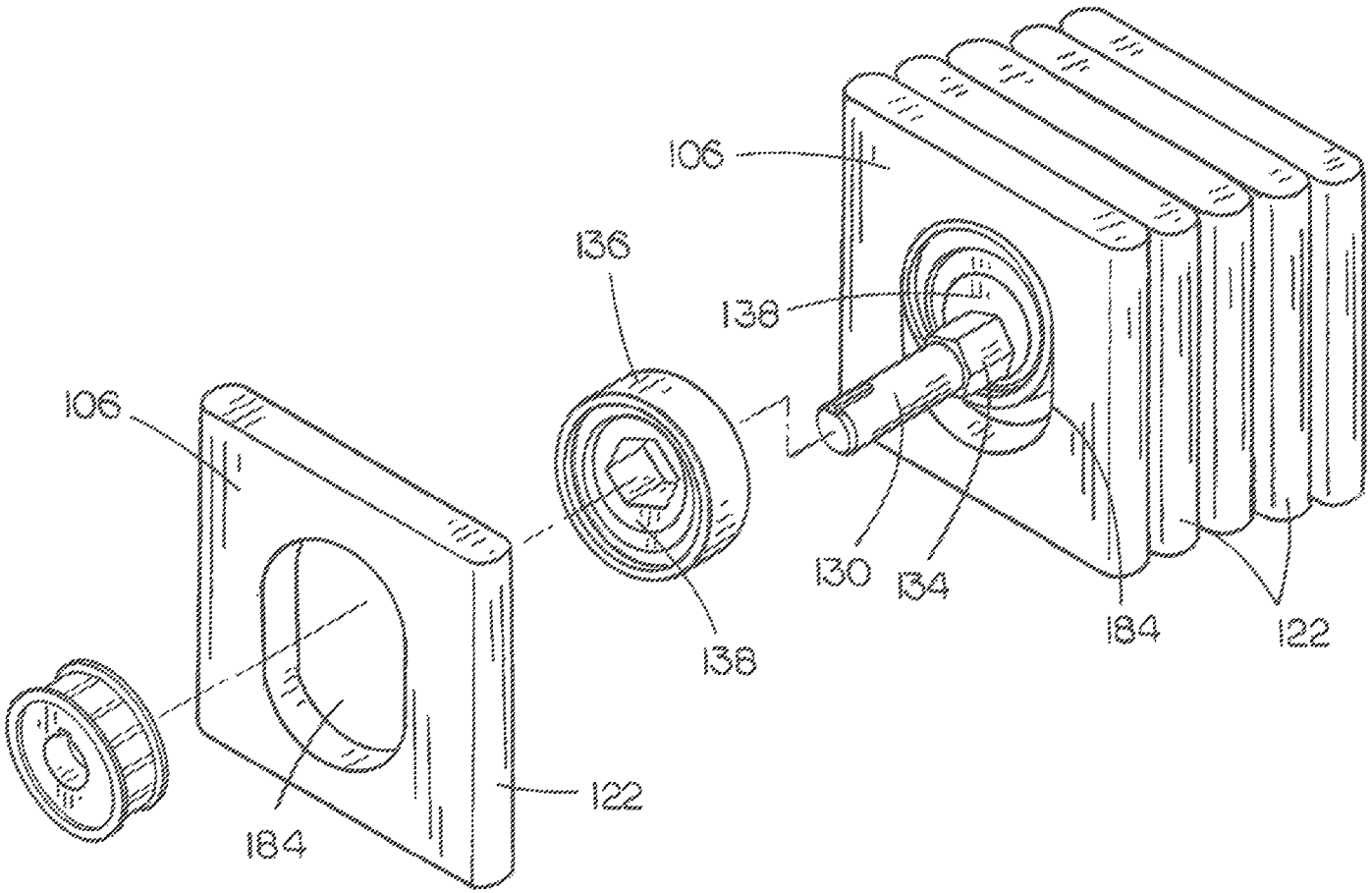
FIG. 7 is an exploded perspective view of a presently preferred pressure plate drive assembly illustrating the hex-drive of one embodiment of the present invention.
Figure 8:
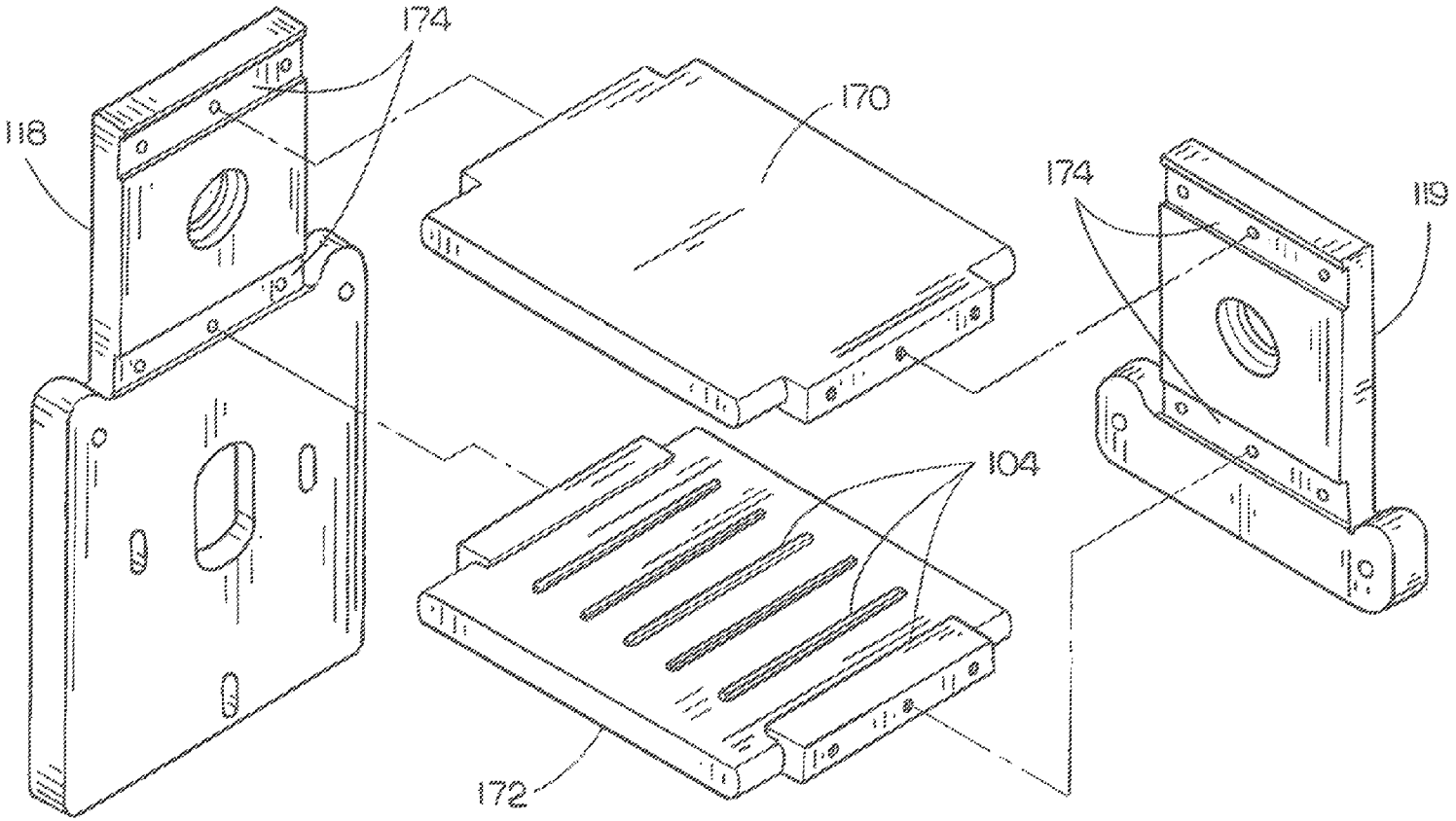
FIG. 8 is an exploded perspective view of a presently preferred pump frame assembly illustrating the pressure plate guides and a presently preferred frame construction.

The pressure plates 106 have radiused ends 122 (FIG. 7). The radiused ends 122 may have a radius of between one-half and five times the diameter of the transfer tube to be utilized. However, a radius approximating the transfer tubing diameter is preferred.

Figure 9:
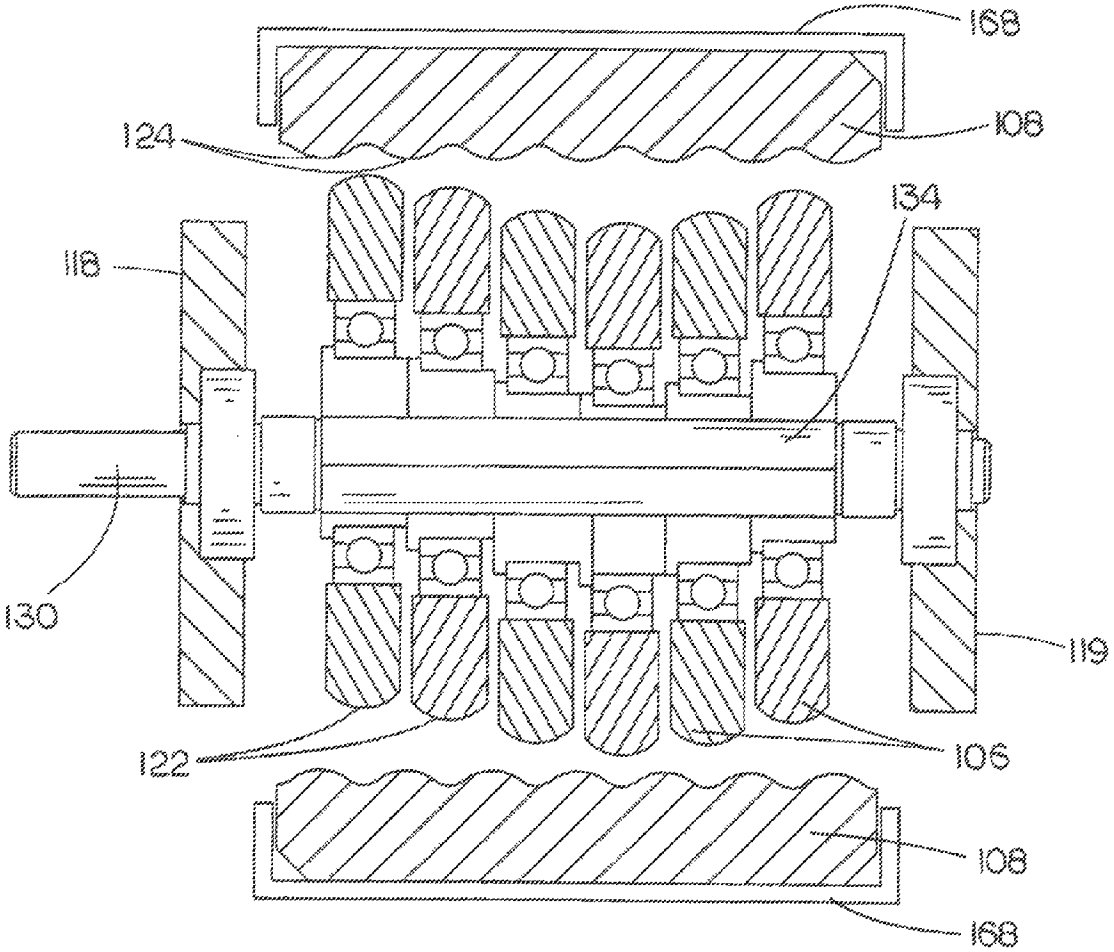
FIG. 9 is a top cross-sectional partial view of a mono-lateral peristaltic pump pressure plate drive assembly illustrating the serpentine pumping action and phase difference between opposing sides of the pressure plates and their respective platens.
Figure 12:
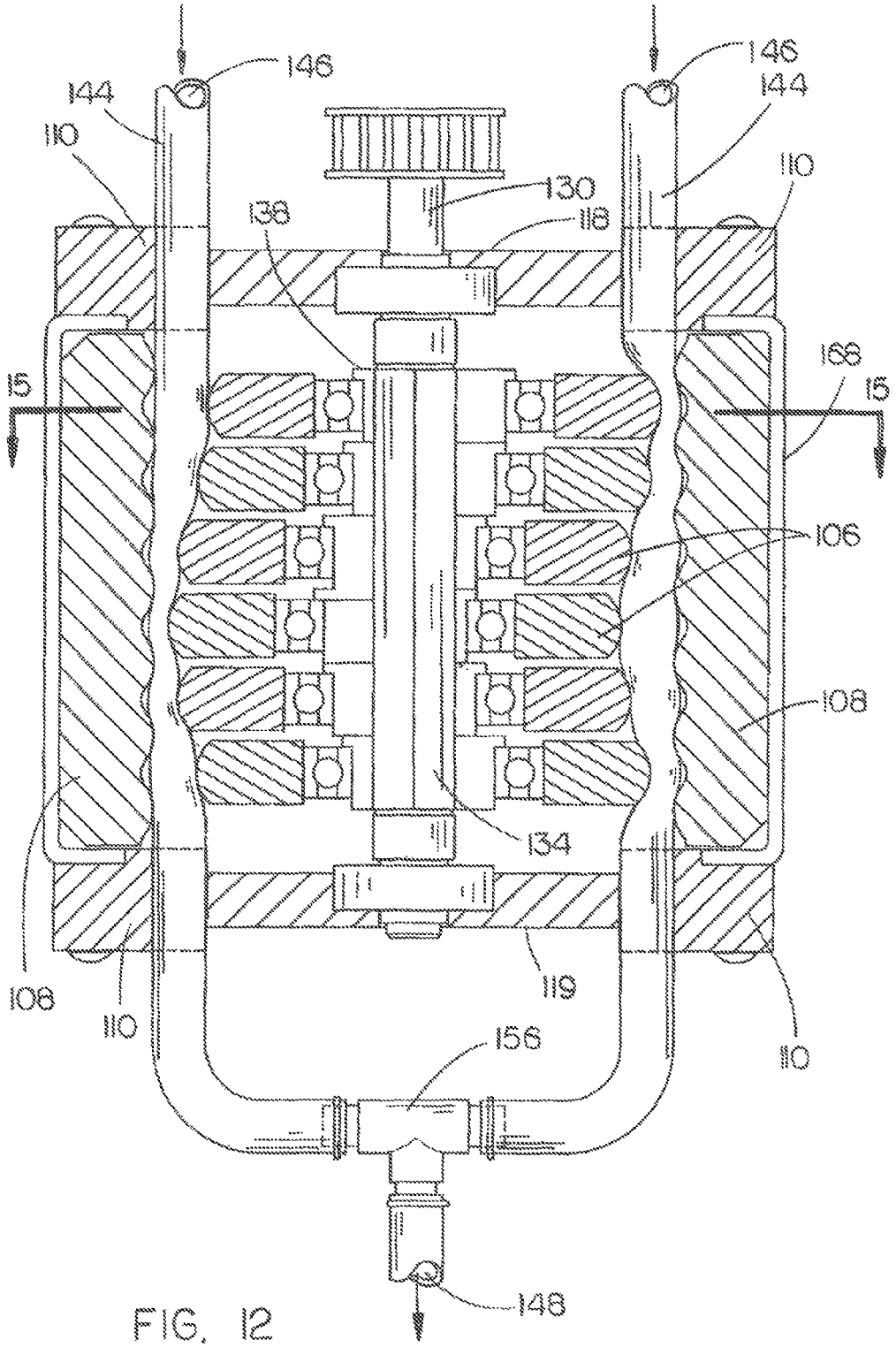
FIG. 12 is a top cross-sectional view of a mono-lateral peristaltic pump pressure plate drive assembly illustrating the serpentine pumping action and phase difference between opposing sides of the pressure plates and their respective platens and showing the transfer tubes occluded between staggered curved surfaces perpendicular to the tubes.
Figure 13:
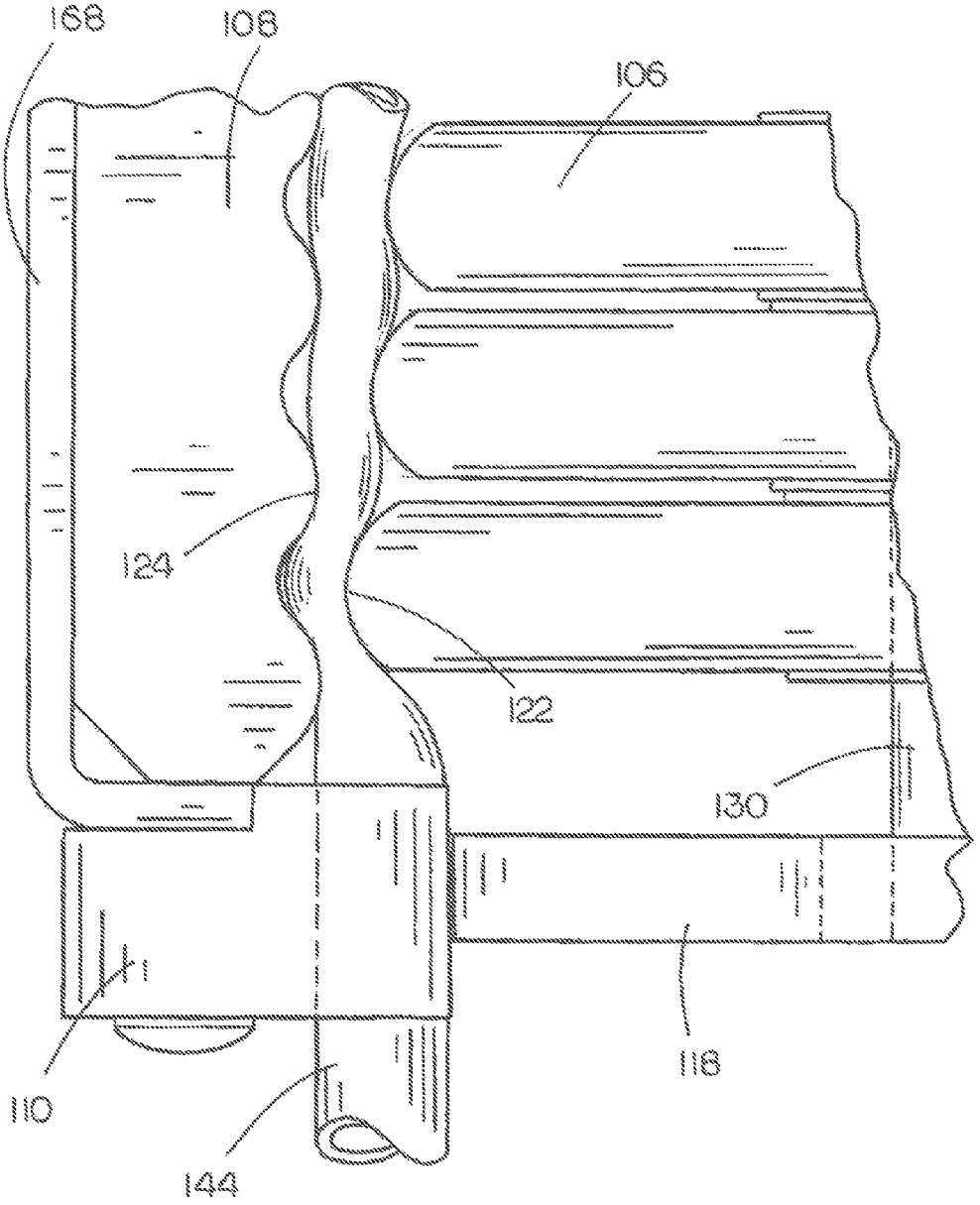
FIG. 13 is a partial schematic view of the pressure plate, transfer tube, and platen pumping action resulting from tube occlusions between staggered curved surfaces.
Figure 19B:
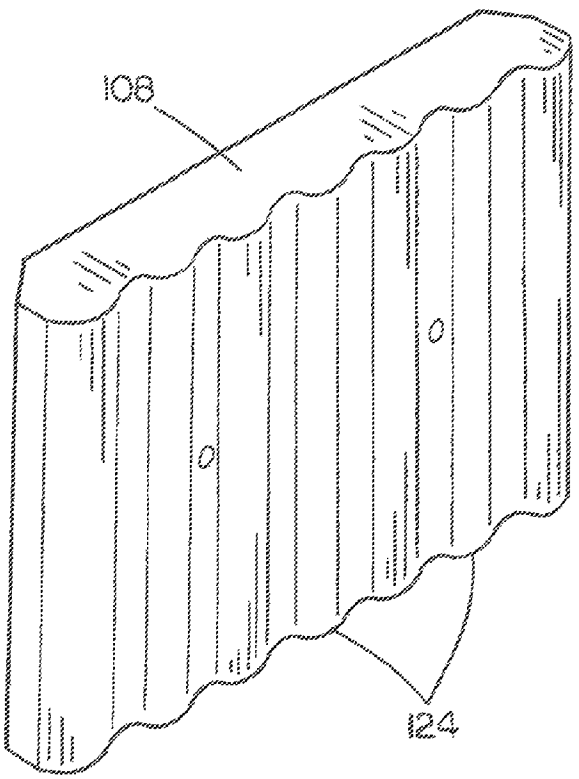
FIGS. 19A and 19B are perspective views of different platens illustrating different thickness configurations for controlling pump sizing.
Figure 19A:
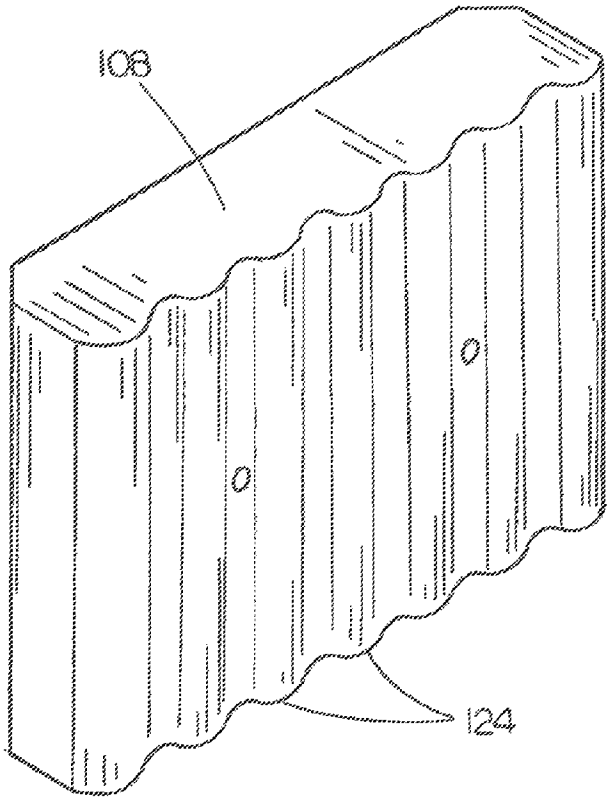

The pump frame assembly (FIG. 2) includes platens 108 having a plurality of curved surfaces 124 (FIG. 9). Platen guides 168 secure the platens 108 in opposed arrangement to the pressure plates 106. The configuration of the pump 100 may be altered to produce varying rates and pressures, by changing platens 108 and the like. For example, a platen 108 (FIG. 9) having a greater or lesser thickness may be utilized to accommodate different diameter transfer tubes 144 (FIGS. 19A & 19B). It will be appreciated that the platens in a preferred embodiment have a cross-sectional profile of a plurality of parallel curved surfaces which are perpendicular to the flow in the transfer tube of the pump. This results in an irregular surface which complementarily interacts with the curved ends 122 of the pressure plates 106 (FIGS. 10A to 10F) so as to occlude (FIG. 12) the transfer tube 144 against the platen 108 between staggered curved surfaces (FIGS. 13 & 14) perpendicular to the transfer tube 144 in a wave sequence (FIG. 16) to promote a peristaltic pumping action.

Figure 14:
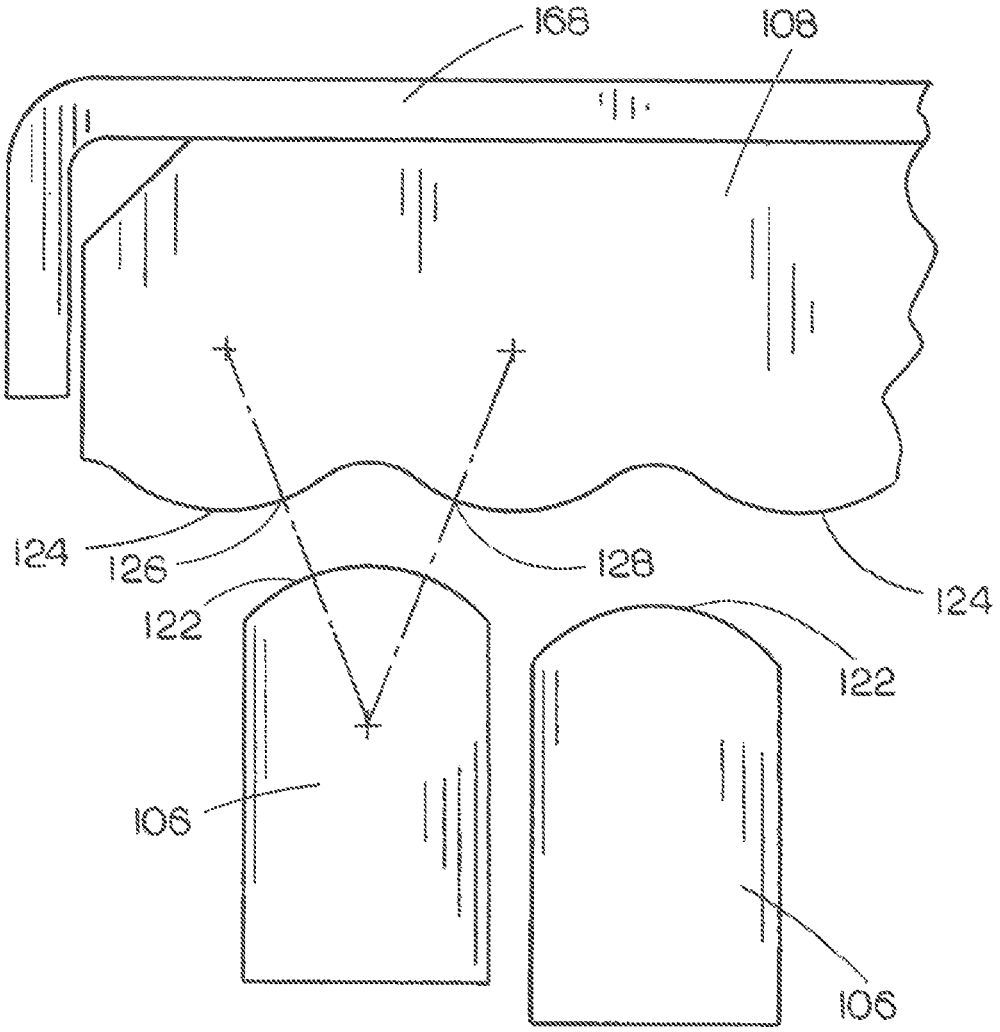
FIG. 14 is a partial schematic view of the pressure plate and platen configuration illustrating staggered curved surfaces of the pressure plates and the platen showing that there are two occlusion points on each curved surface.

The staggered curved surfaces of the pressure plates 106, and platen radiuses 124 interfaces produce a first and second occlusion point 126, 128 (FIG. 14). The two occlusions 126, 128 between staggered curved surfaces allow the pump to produce heretofore unobtainable linear peristaltic pump pressures and vacuums. Additionally, by occluding the pumping tube (transfer tube 144) between staggered curved surfaces (pair of occlusion points 126, 128) pump backflow is prevented. It will be appreciated that the pumps 100, 200 of the present invention, when configured in accordance with the recited preferred embodiment, are generally capable of producing a vacuum sufficient to raise a column of water 30 feet or a column of mercury 27 inches (approximately 70 Torr). Likewise, the recited pump configuration produces generally equal forces on the opposing sides of each transfer tube occlusion. This reduces transfer tube wear (delamination and the like) and heat in the transfer tubing. It will be recognized that heat and shear forces damage pumped cellular material such as blood and the like. Additionally, the pump 100 of the present invention produce a more even flow.

In a presently preferred embodiment the radiuses for the curved surfaces for various tubes are provided:

| Tube OD | Radius |
|---|---|
| 3/8 inch | 9/32 inch |
| 1/2 inch | 5/16 inch |
| 1 1/4 inch | 9/16 inch |

Collar 110 openings may be slightly undersized so as to better secure the transfer tubing 144.

Figure 20:
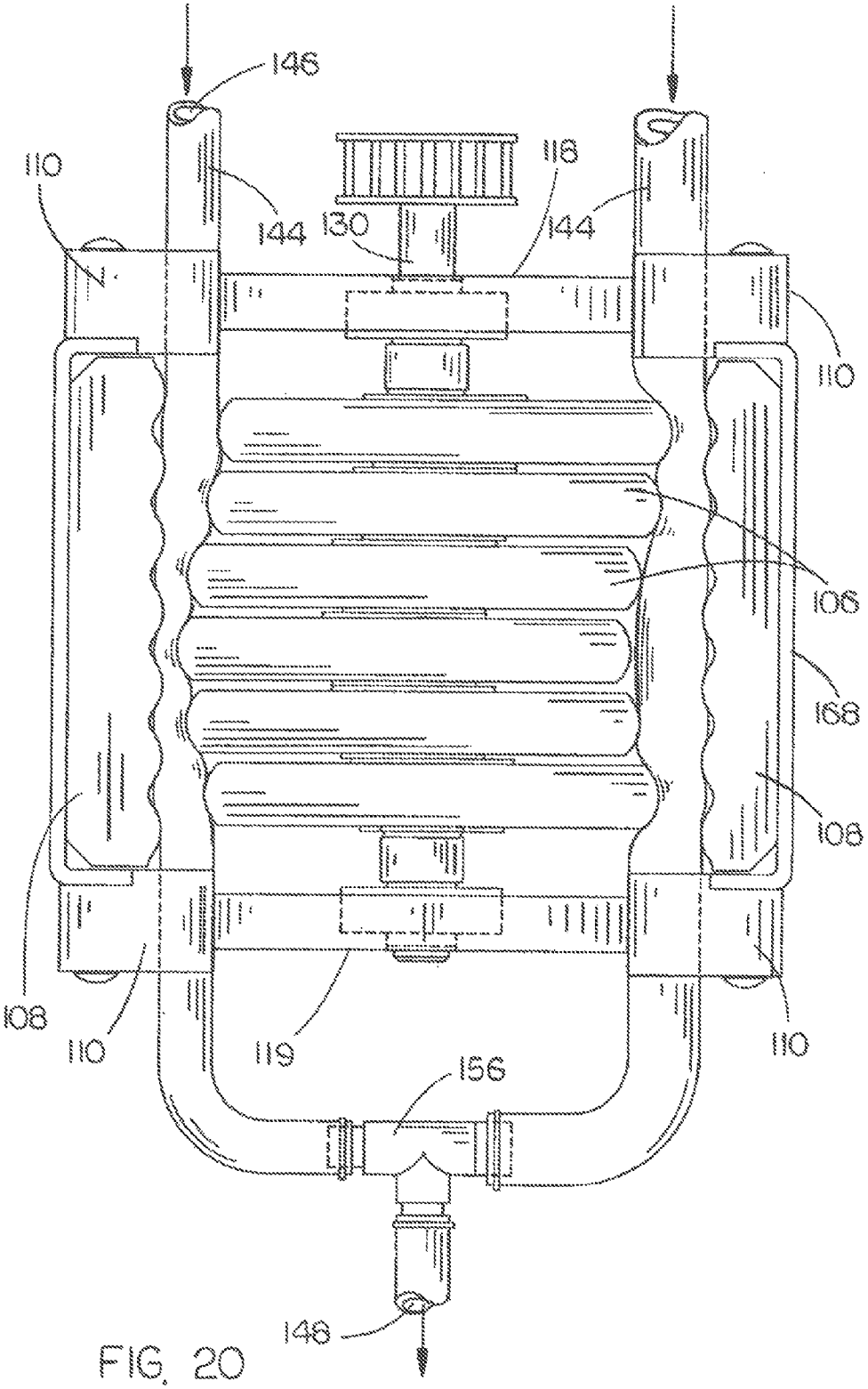
FIG. 20 is a top schematic view of a mono-lateral peristaltic pump utilizing two tubes of different diameters, diagrammatically illustrating the pump producing a pumped mixture of two fluids at different ratios.

In a preferred embodiment, the pump 100 is configured as shown in FIG. 1 with transfer tube collars 110. The collars 110 are adjustably mounted to the platen assemblies with collar fasteners 112 or the like. In operation, it is desirable to allow differently configured collars 110 to be utilized. For example, collars for more or fewer transfer tubes, different sized transfer tubes, or transfer tubes with differing retention requirements (tube stiffness, thickness, flexibility, memory, and the like). In operation, the pumps may be configured to pump and mix multiple materials at a specified ratio by utilizing transfer tubes of different sizes (FIG. 20) and/or a different number of transfer tubes for different materials (FIGS. 21, 22, 23, et al).

As shown in FIG. 1, the transfer tubes 144 may be of a different material than the input or output tubes 146 and 148. For example, in the mono-lateral pump 100 the transfer tubes may be joined to the input tubes 146 via connectors 176 and the output tubes 148 may be joined to pairs of opposing transfer tubes 144 via a T-connector 156. This configuration reduces spurting (non-continuous) flow as the two sides of the mono-lateral pump are out of phase (FIGS. 12, 15, 16, & 17). This reduction in flow pulsation without a pressure and rate restricting pulse dampener is unique. It will be appreciated from the schematic diagram of FIG. 17 that the pumped portions 178, 180 are generally joined 182 together at the T-connector 156. This allows for more consistent, reliable and controllable rates of delivery.

Figure 2:
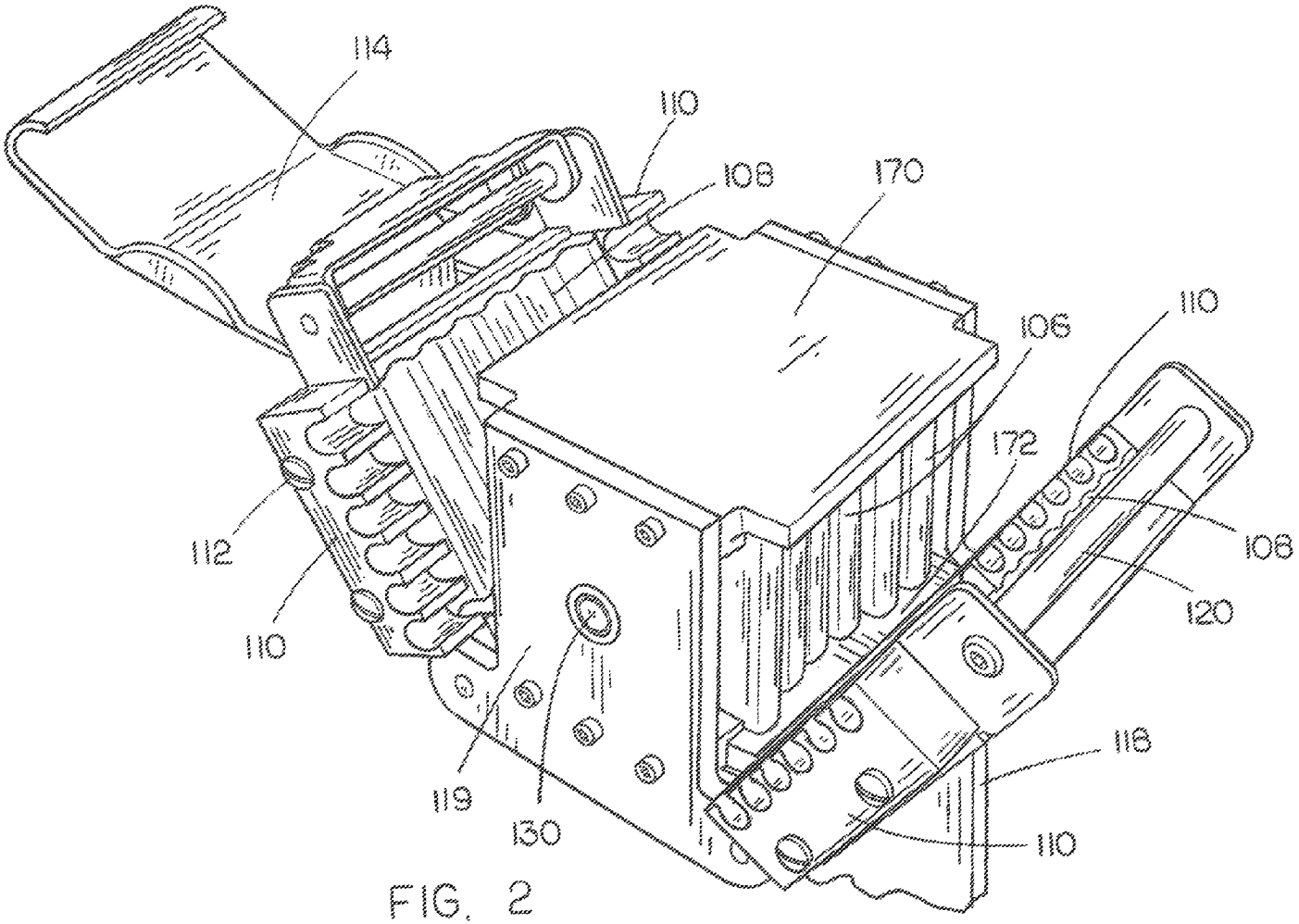
FIG. 2 is a partial perspective view of a multiple output mono-lateral peristaltic pump in an open position illustrating the pressure plates, platens, pump tube collars, and presently preferred latching mechanism.
Figure 3:
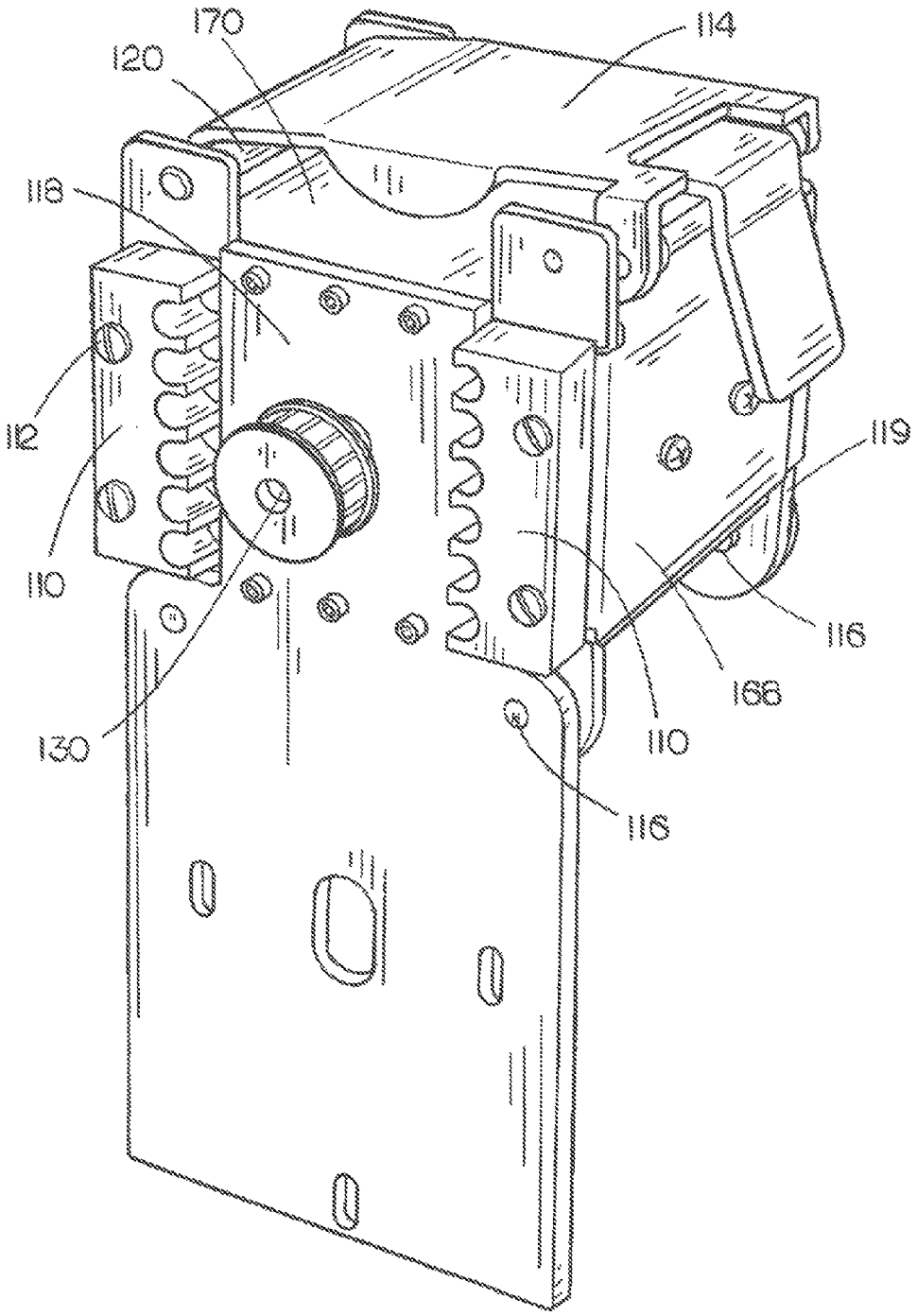
FIG. 3 is a perspective end view of a multiple output mono-lateral peristaltic pump in a closed position illustrating a preferred pump frame assembly and motor mount configuration.
Figure 4:
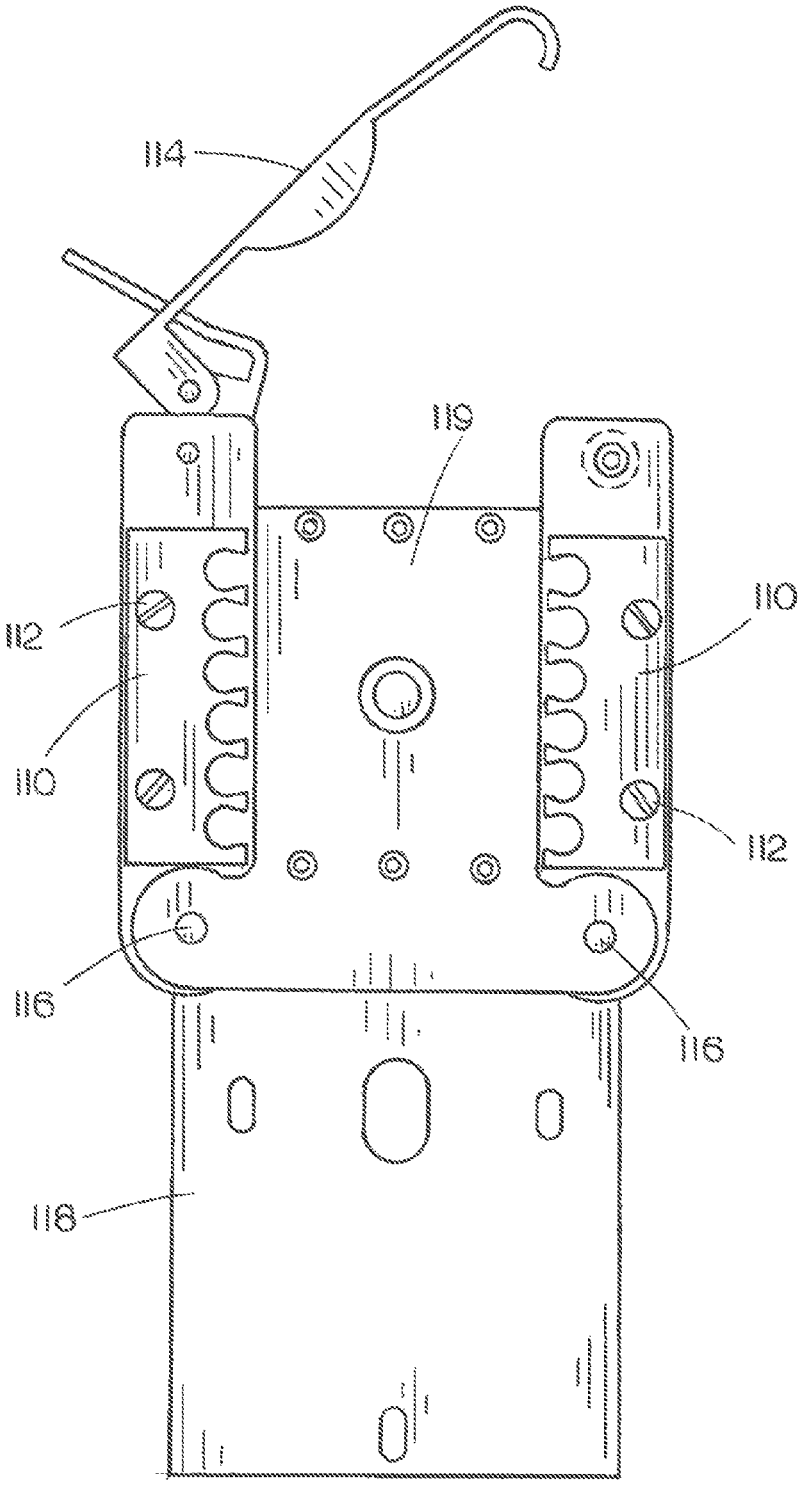
FIG. 4 is a front elevation view of a multiple output mono-lateral peristaltic pump where the latch mechanism is in an unfastened position.

FIG. 2 illustrates the mono-lateral pump 100 unlatched and in an opened position ready to accept transfer tubes 144. The latch 114 secures both platens 108 in a spaced apart configuration opposing the pressure plates 106 via the latch pin 120 and pivot pins 116 (FIG. 3). The transfer tubes are secured between the collars 110 and the assembly is latched (FIG. 3). As the drive shaft 130 (FIG. 3) is rotated via the motor 150 and drive mechanism 132 (FIG. 1) the pressure plates 106 move in a peristaltic wave (FIGS. 10A to 10F).

Figure 5:
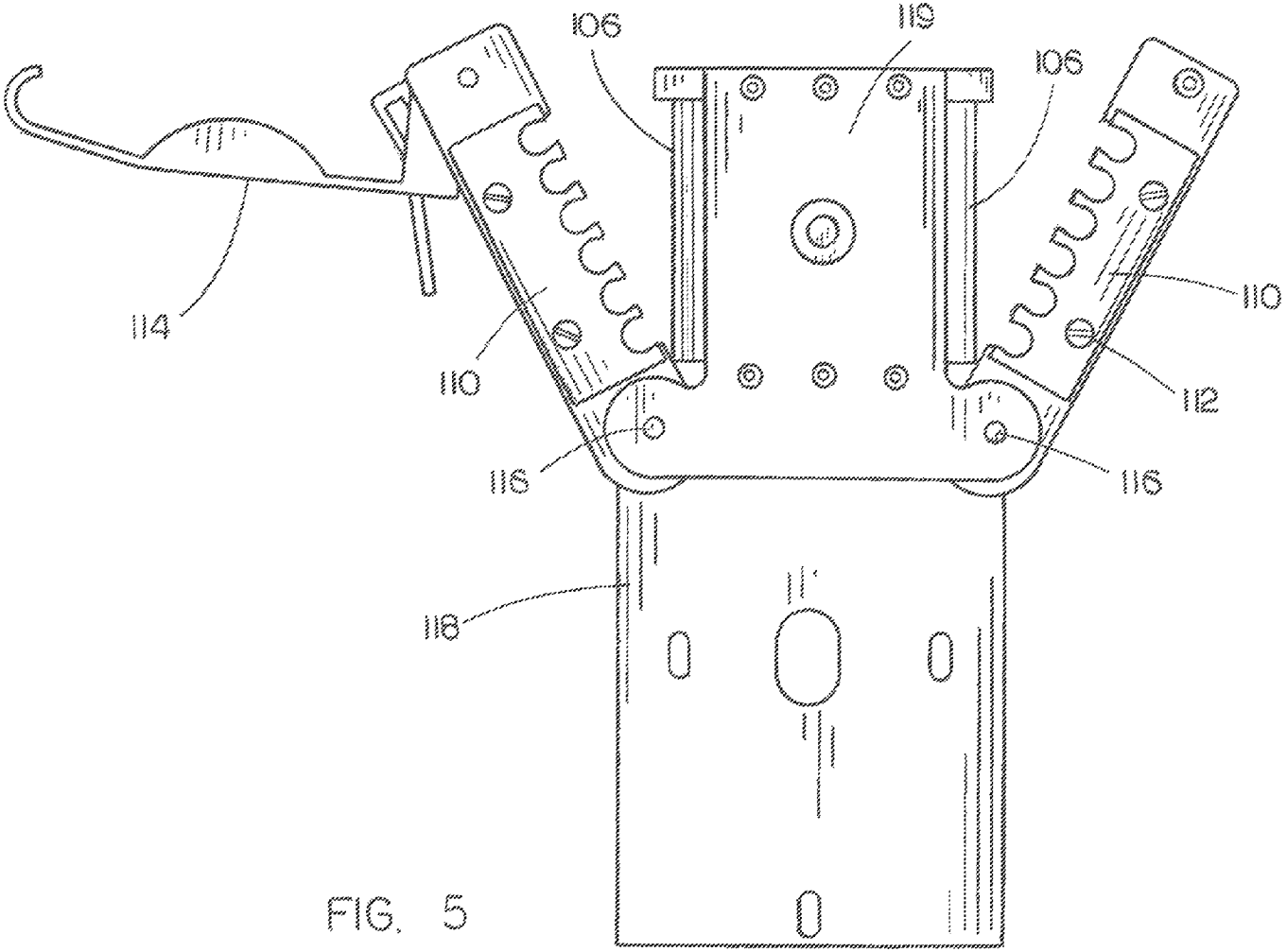
FIG. 5 is a front elevation view of a multiple output mono-lateral peristaltic pump where the pump is in an open unlatched position.

Limiters 142 (FIG. 15) control the angle the platen assemblies are allowed to open (FIGS. 2 & 5).

Figure 11A:
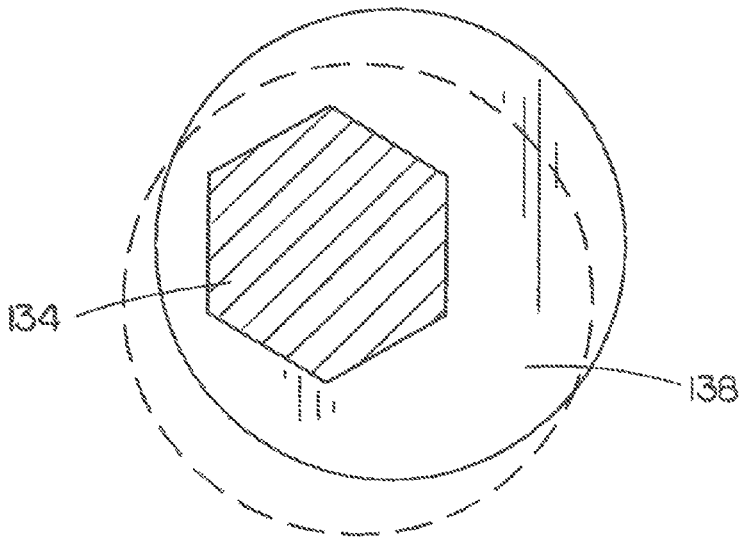
FIGS. 11A and 11B are cross-sectional end views of the geometric-drive system of the present invention (in a hexagonal configuration) wherein FIG. 11A schematically illustrates eccentric shift in a $1/6^{th}$ rotational interval and FIG. 11B schematically illustrates the eccentric shift in a full rotation at $1/6^{th}$ intervals (as illustrated by FIGS. 10A-10F)
Figure 11B:
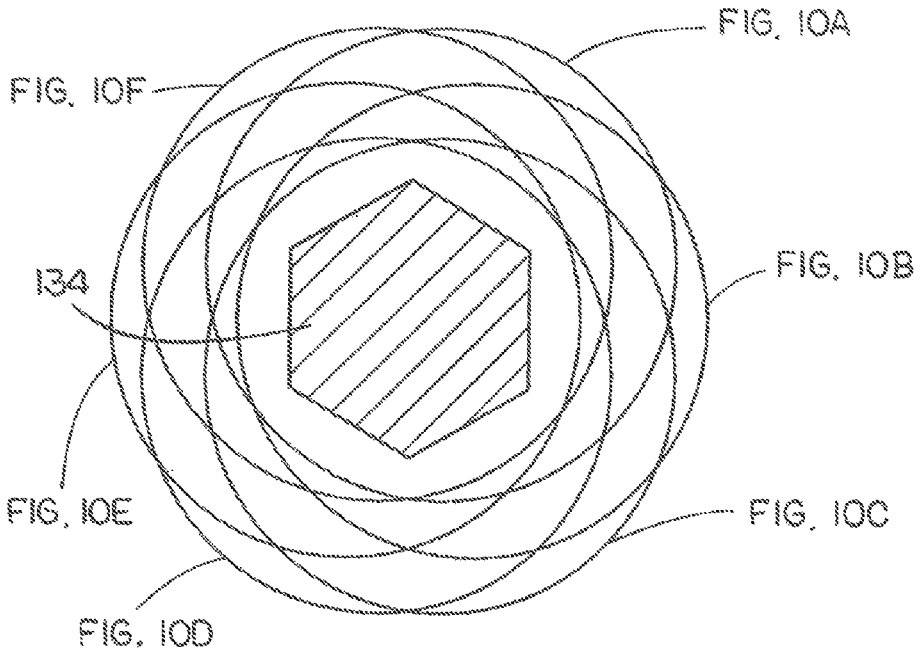
Figure 15:
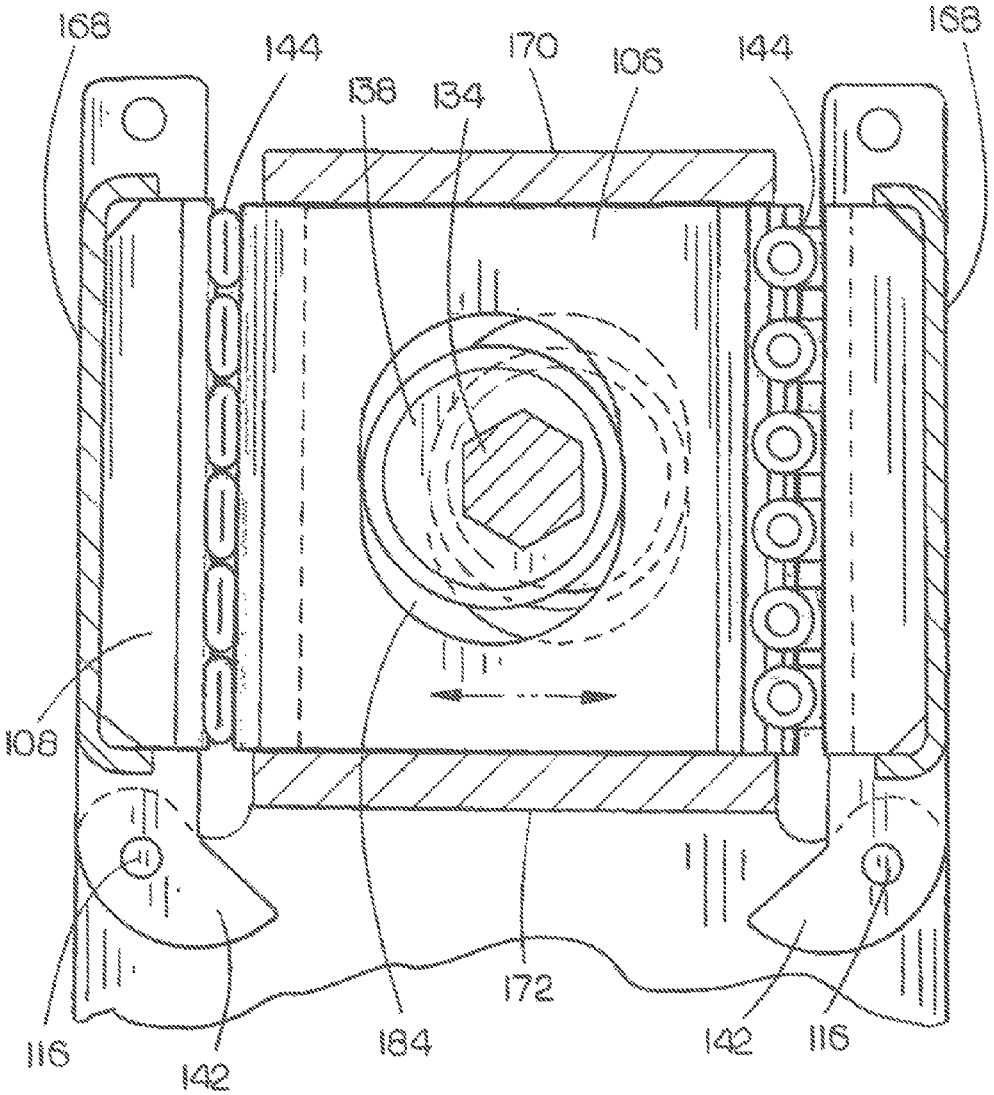
FIG. 15 is a partial cross-sectional end view of the geometric drive assembly of the present invention wherein the phase difference between the first side and the second side of the pump are illustrated as indicated by cross-section arrows on FIG. 12.
Figure 16:
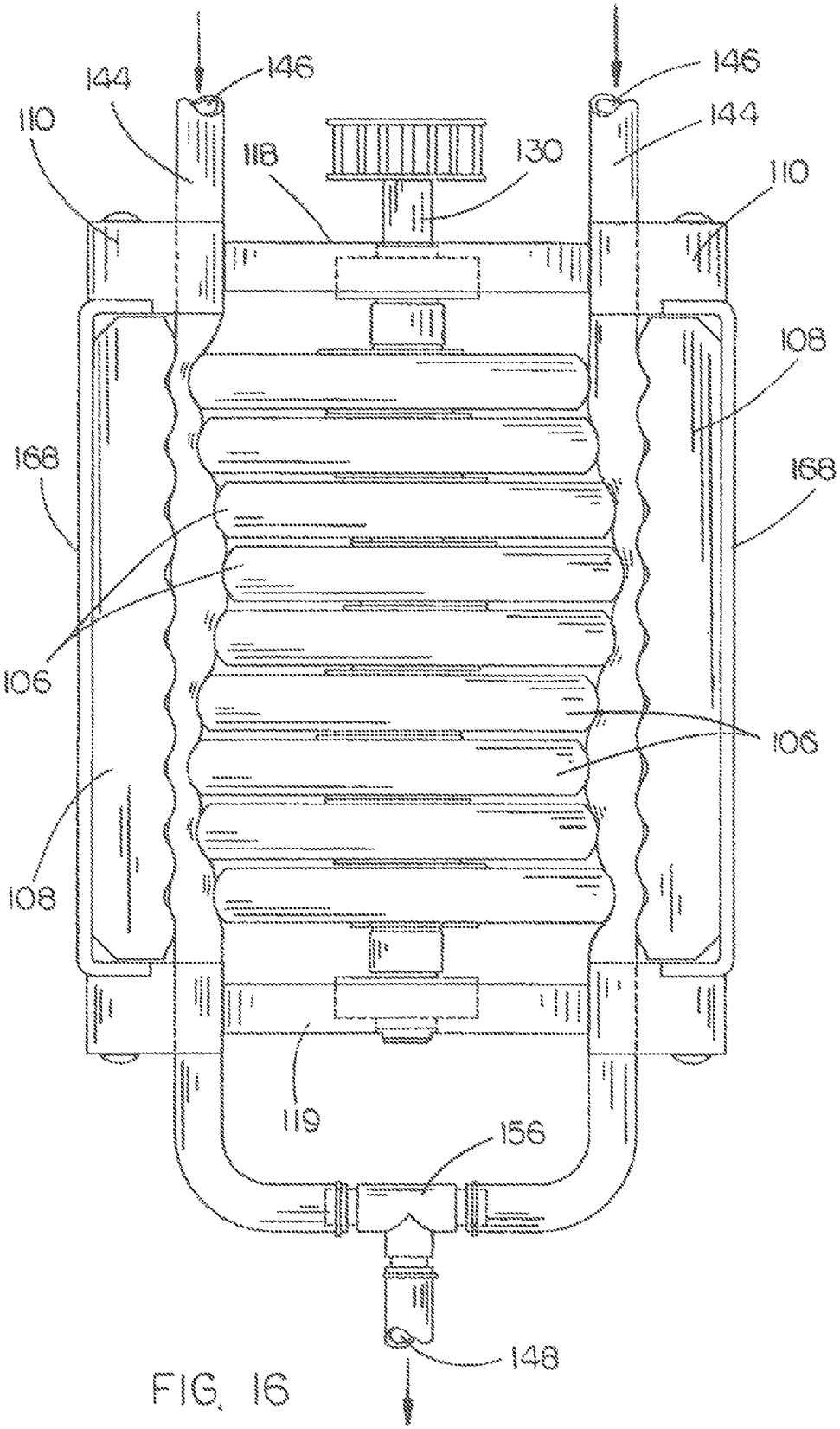
FIG. 16 is a top cross-sectional view of a mono-lateral peristaltic pump pressure plate drive assembly illustrating the serpentine pumping action and phase difference between opposing sides of the pressure plates and their respective platens showing the transfer tubes occluded between staggered curved surfaces perpendicular to the tubes in a nine pressure plate overlapping 1.5 rotation increased pressure configuration.
Figure 17:
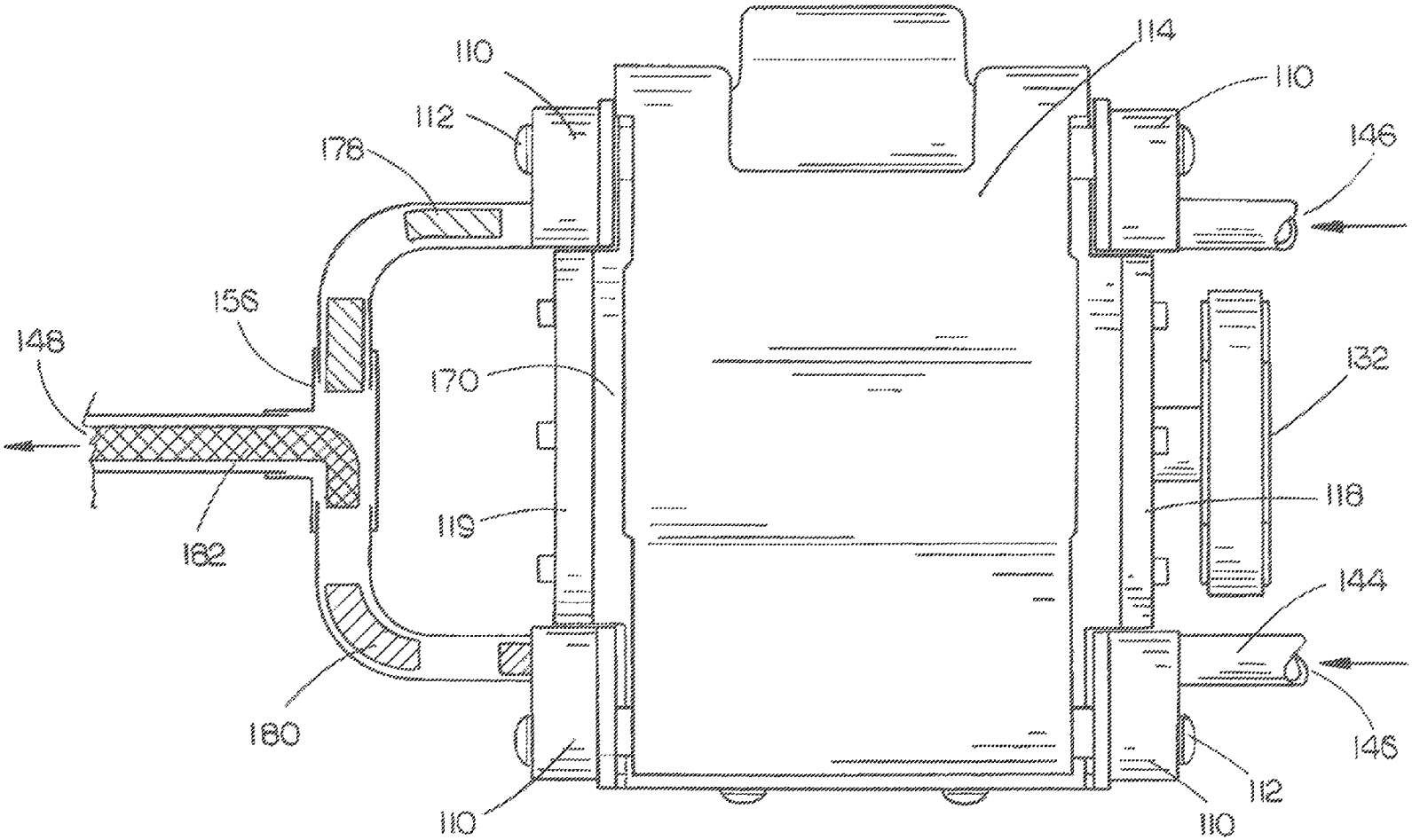
FIG. 17 is a top schematic view of a mono-lateral peristaltic pump diagrammatically illustrating the joined flow of the outputs on either side of the pump for reducing output spurting in flow and overall pumping variance.

FIG. 7 illustrates a preferred pressure plate 122 drive assembly. Each pressure plate 106 has an elliptical shaped void 184. The drive shaft 130 includes a hex drive portion 134 and a pressure plate bearing 136 for each pressure plate 106. Each pressure plate bearing 136 has an eccentric insert 138 with a hexagonal void which is driven by the drive shaft 130 to perform the oscillation of the pressure plates (FIGS. 11A & 11B). The pressure plate 106 voids 184 are then utilized to drive the pressure plates 106 in a reciprocal motion in a wave sequence (FIGS. 15 & 16).

Figure 6:
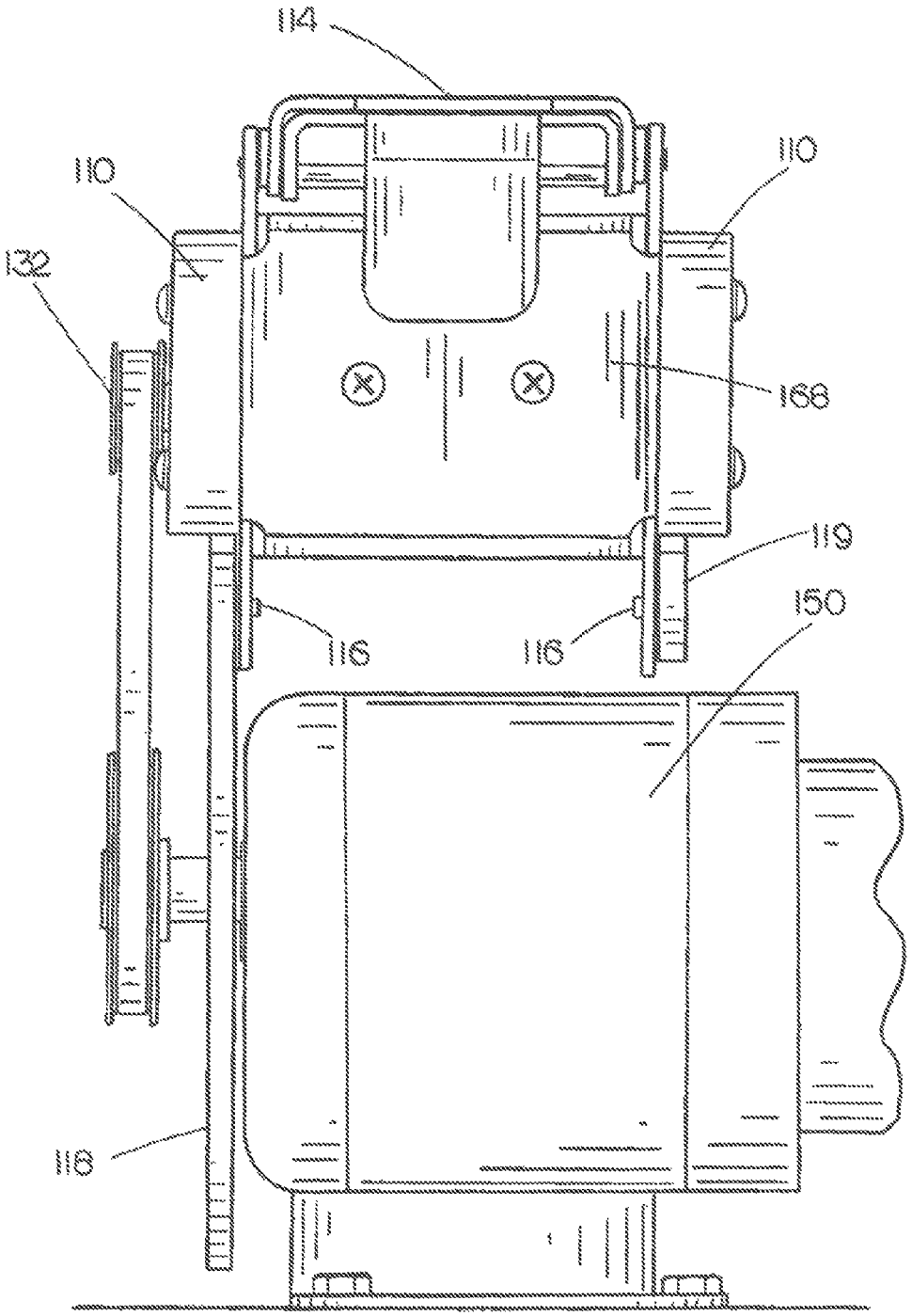
FIG. 6 is a side elevation of a multiple output mono-lateral peristaltic pump illustrating a presently preferred drive and mounting configuration.

FIG. 6 illustrates a presently preferred pump belt drive and mounting configuration. It is anticipated that reduction gears, chains, direct drive, stepper motor drive and the like may also be utilized.

FIGS. 18A & 18B illustrate means for adjusting pump characteristics, for example, altering the size of the elliptical void 184, increasing the length of the pressure plates 106, increasing the width of the pressure plates 106, changing the eccentric 138, or the like. FIG. 18C illustrates different radiuses 122 on a pressure plate 106.

Figure 21A:
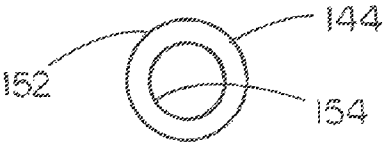
FIGS. 21A, 22A, and 23A are schematic end views of transfer tubing having different diameters (ODs) and interior diameters (IDs) but having the same wall thickness.
Figure 21B:
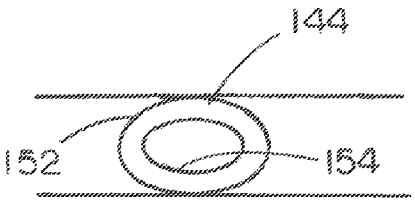
FIGS. 21B, 22B, and 23B are schematic end views of un-occluded transfer tubing of different sizes, but substantially the same wall thicknesses, between an opposing pressure plate and platen, the plate and platen spaced apart by a distance x1.
Figure 21C:
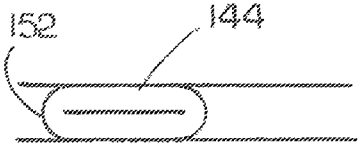
FIGS. 21C, 22C, and 23C are schematic end views of occluded transfer tubing of different sizes, but substantially the same wall thicknesses, between an opposing pressure plate and platen, the plate and platen spaced apart by a distance x2.
Figure 22A:
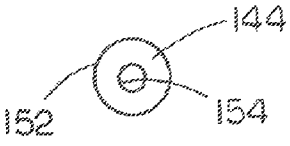
Figure 22B:
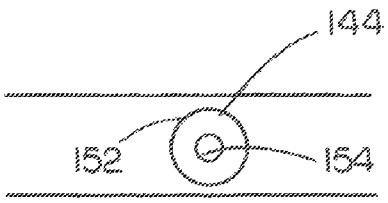
Figure 22C:
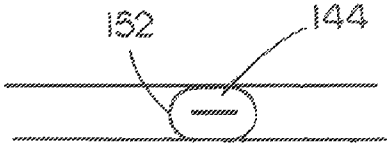
Figure 23A:
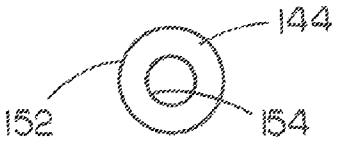
Figure 23B:
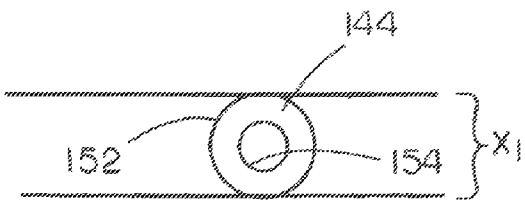
Figure 23C:
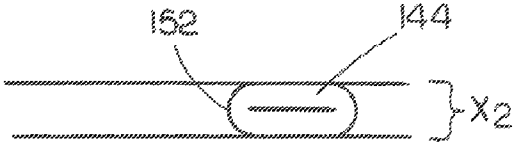

FIGS. 21A, 22A, and 23A illustrate transfer tubes 144, having different outer diameters 152 and different inner diameters 154, but all with generally the same wall thickness. FIGS. 21B, 22B, and 23B illustrate the cross-sectional configuration of transfer tubes having like wall thicknesses but different outer diameters in a non-occluded (open) position. FIGS. 21C, 22C, and 23C illustrate the cross-sectional configuration of transfer tubes having like wall thicknesses but different outer diameters in an occluded (closed) position. Those skilled in the art will recognize the adaptability of the present pump to accommodate varying sizes of transfer tubing without adjustment to the platen or pressure plates.

FIGS. 24 to 29 illustrate components of a bilateral embodiment of the peristaltic pump 200 of the present invention. In the bilateral embodiment 200 platens are not required. Opposing pairs of pressure plates 226 push against opposite sides of a transfer tube 240 (FIG. 24).

FIG. 24 illustrates the bilateral pump 200 in a closed and ready for operation configuration. The pump 200 includes a frame 202 consisting of a main pressure plate assembly frame 218 and a secondary pressure plate assembly frame 220 (FIG. 25). Each of the first and secondary pressure plate assembly frames 218, 220 include a plurality of pressure plates 226. The pressure plates are guided and maintained in an operative spaced apart parallel arrangement via a plurality of pressure plate guides 204 shown in FIGS. 24, 25 and 26 (not shown, FIG. 29, illustrated by 104, FIG. 8).

As illustrated in FIGS. 25 and 26, the bilateral pump 200 secondary pressure plate assembly may be swung open so as to allow transfer tube(s) to be loaded. The two pressure plate assemblies 218, 220 are hinged about pivot pin 216 (and drive spindle) (FIG. 25). The two pressure plate assemblies are held in operating position via an adjustable latch mechanism 214, 222, 224 (FIG. 27). The distance between the two pairs of opposing pressure plates may be adjusted to accommodate change in occlusion on the transfer tubes. Additionally, the amount of compressive force applied to a given diameter of tubing may be adjusted via the latch adjustment mechanism 224 (FIG. 25). The transfer tube(s) 240 are retained via a pair of collars 248 (FIGS. 26 & 28A, 28B, & 28C). The collars 248 may be readily removed and replaced with collars designed to accommodate different tubing types (FIGS. 28A, 28B, & 28C).

FIG. 25 illustrates the drive assembly 234, which includes a motor 246, main drive assembly 234, and secondary drive assembly 236. The pressure plates 226 are driven in a preferred embodiment in the same manner as in the monolateral pump 100 (FIG. 7). FIG. 29 best illustrates the peristaltic pumping action of the opposing pressure plates.

FIG. 30 illustrates a preferred means for preventing pump contamination in the event a transfer tube 140, 240 ruptures. In such a configuration the safety tubing 188 acts as a sleeve around the protected transfer tube 190. In operation both ends of the safety tubing 188 may be placed into tube rupture reservoirs (not shown). If a transfer tube ruptures its contents are dispersed between the outer diameter of the protected transfer tube 190 and the safety tubing 188 and then flow into tube rupture reservoirs. Safety tubing 188 can be utilized in this linear pump configuration because there is no rolling action of the tube and minimal linear pull on the tube.

The preferred materials for the pressure plates, platens, and collars are either machined Delrin® (Acetal-(PolyOxy-Methylene)) or molded Ultra-High Molecular Weight Polyethylene (UHMW-PE). Transfer tubing is preferably Masterflex® Norprene, or a like Masterflex® tubing selected for the required application. The metal components are preferably manufactured from machined or cast aluminum and stainless steel laser-cut components.

It should also be appreciated that: (1) The eccentrics (cams) 138 (FIG. 7) on the drive shaft 130 manipulate a single set of pressure plates 106 with two opposing sets of curved surfaces in cooperation with two platens 108 (with curved surfaces which are staggered in relationship to those of the pressure plates 106) will occlude two separate transfer tubes in opposition to each other in occlusion, and where, when the two transfer tubes are joined on the output, a near constant flow of the pumped fluid is produced; (2) The drive shaft 130 eccentrics (cams) 138 are in a spiral form over the length of the powered shaft whereby the transfer tubes are occluded in a wave pattern over the staggered curved surfaces to promote flow within the transfer tubes; (3) The present pump promotes laminar flow and minimizes turbulence within the fluid being pumped; (4) The transfer tube(s) may be replaced without affecting occlusion settings; (5) The present pump minimizes tubing shear stresses; (6) The present invention prevents rolling of the transfer tube during pumping; and (7) As shown in FIGS. 16 and 29, greater than six pressure plates, for example, nine pressure plates producing an overlapped cycle (1.5 cycles per rotation) may be utilized to improve the performance of the pump for pressure (or suction).

FIGS. 31 through 37D illustrate a rotary peristaltic pump 500 embodiment of the present invention. The rotary peristaltic pump 500 is driven via a transmission 502 via a motor 504. In a currently preferred embodiment a single pump tube 506 having a quick connect output is wrapped around rotary platen assembly 510. The rotary platen assembly 510 includes a plurality of rollers (eleven) 512 on axles 514 rollably secured via the platen hub 516. The rotary platen assembly 510 is rotatably secured to an eccentric drive shaft 518 via a retention clip 520 within fixed platen 522 having opposing curved surfaces interacting with rollers 51 peristaltically interacting with pump tube 526 for pumping material through said tube 526. Rotary platen assembly cover 528 secures the pump tube(s) 526 within the pump and may be removed to quickly replace a worn or new sized pump tube via a fastener(s) 530 or the like. The eccentric drive shaft 518 is rotatably secured to housing bearing and pump frame 532 via frame fastener(s) 534. An output quick connect coupling 508 connected to output tubing 536 may be connected to the pump tube 526 through a pump tube quick connect coupler 538. In a currently preferred embodiment PARKER CARSTICK® (3100 or the like) system fluid connectors 622 are utilized where quick tube connection and replacement is desired. Pump tube 526 is retained within the pump 500 via an input retainer 540 and an output retainer 542.

In operation a rotary peristaltic pump of the present invention (FIG. 31) may be driven by a DC motor of fractional horsepower at 500 rpm to rotate the platen assembly 510 (approximately 10.5 cm in diameter) at approximately 500 rpm. Utilizing a single pump tube 506 of ID six 6 mm and OD of one cm a fluid may be pumped at a pressure of 80 psi (28.0" inch vacuum) and rate of 2.2 liters/minute. FIG. 34 illustrates the various components and assemblies of a currently preferred rotary peristaltic pump of the present invention 500. The rotary pump 500 of the preferred embodiment described herein can successfully pump peanut butter (pump tube 0.50" OD and 0.25" ID) at a rate of at least 2 liters per minute. The drive shaft 518 is 0.625 inches in diameter and on eccentric center displacement of 0.213 inches on a 0.250-inch wide plate offset by opposing bearing plates of 0.063×0.750 inches. The plate is preferably 1.301 inches in diameter and may be elliptical. The platen hub 516 is 4.125 inches in diameter and 2.036 inches wide. The bearing hub shaft pace of the platen hub 516 attaches to drive shaft 518 elliptical shaft for elliptical rotation within the fixed platen 522. Mounted to the hub assembly are 11 equally spaced rollers 512 having a diameter 0.720 inches and a length of 1.60 inches. Each roller is radially spaced at 32.75° by pins 514 at 1.353 inches from the center of the platen hub 516. The fixed platen 522 is preferably 6.0×6.0×1.580 inches with a notched inlet of 0.375 inches in diameter 1.25 inches and 0.404 inches from the platen assembly cover 528 face of the fixed platen 522. The outlet is preferably on the opposing side of the fixed platen offset near the pump frame 532 side of the fixed platen 522. The fixed platen includes 12 curved surfaces 524 offset at 30° from each other with a peak to trough distance of 0.381 inches and forming a gap between the rollers 512 of approximately 0.200 inches. A pump tube of 10.996 inches and 0.500 diameter (OD) with a ID of 0.25 inches will pump over ½ gallon per minute (gpm): ($V_R$=lNy) where $V_R$ is fluid volume pumped per revolution, l is pump tube length, and N is the cross-sectional area of the pump tube (y is the fraction of pump tube length subject to occlusion between curved surfaces of the rollers and fixed platen). The platen assembly cover 528 of the rotary platen assembly 510 (face flange) works to retain the pump tubing within the pump 500 housing.

FIG. 37 illustrate the rotary peristaltic pump 500 in operation. FIG. 37A is a front elevation illustrating the left-to-right (counterclockwise) flow of fluid pumped through the pump 500. From FIG. 37 those skilled in the art will note that the drive shaft 518 rotates counterclockwise while the rotary platen assembly 510 rotates clockwise within the fixed platen 522. In FIG. 37A the opposed curved surfaces of the fixed platen 522 and rollers 512 have occluded the pump tube 526 near the inlet and outlet. As the drive shaft 518 rotates counterclockwise, the rollers rotate clockwise about the platen hub 516 as it rotates counterclockwise (FIGS. 37B-37D).

FIGS. 38 through 48 illustrate a manifold assembly 600 having an output assembly 602 (*a,b*) and an input assembly 604 (*a,b*) for connecting to pumping tubes 604 having retention registration clips 606 (*a,b*) on opposing ends for securing the pump tubes in place during operation via tube retention assembly 608. FIG. 38 illustrates a twin action peristaltic pump 600 with a preferred manifold. Distribution of fluid entering the twin input manifolds 604 (*a,b*) may be from a single source or multiple sources (FIG. 45). Additionally, each pump tube 526 may have an independent source (where the input is configured like the output 602 as shown in FIG. 39). FIG. 41 shows the quick replacement feature of an embodiment of the manifold of the present invention. Pump tubes 526 may include securement ends 606 (*a,b*) for stretched retentional engagement across the opposing curved surfaces of pumps of the present invention.

FIG. 42 illustrates a manifold assembly with nipples 612 for friction fitment of out/in put tubing for various applications of pumping multiple materials or single materials at like or different rates within the same pump (FIGS. 43-45). FIG. 45 illustrates a manifold having three chambers each feeding at least a pair of nipples having different dimensions (616, 618, and 620). Pump tubes 526 with compatible internal dimensions may be selected for independently pumping different material at different rates or mixing different material in different ratios. FIGS. 47 and 48 illustrate the use of quick connectors for ready configuration of various embodiments of the present invention. In the food preparation industry, for example microwavable meals and the like, where various courses may be frozen in compartments on a disposable tray, various sauces, and foods may be metered onto fast moving trays during manufacture. For example, chocolate sauce, pasta sauce, soup, mashed potatoes, steak sauce, and the like.

FIGS. 49 and 50 illustrate a spray application of the pumps of the present invention. In crop production sprayers 4900 (FIG. 49) having booms and spray heads are commonly utilized to spray crop materials such as growth promoters, fertilizers, pesticides, herbicides, and the like. Pumps of the present invention (FIG. 50) may be configured in a manifold for distributing sprayed materials.

I claim:

1. A rotary peristaltic pump, comprising:

a pump frame;

a platen operatively associated with the pump frame, including a periodical plurality of N staggered curved surfaces around the inner circumference of the platen;

at least one transfer tube having a wall thickness, an inside diameter, an outside diameter, an input end, and an output end, the at least one transfer tube operatively coupled to the inner circumference of the platen;

a drive shaft mounted to the pump frame;

a platen assembly rotatably secured to the drive shaft, configured to elliptically rotate at an eccentric displacement from the drive shaft axis;

a plurality of N−1 rollers rollably secured to the platen assembly, each roller mounted to an axle along its longitudinal axis, each axle mounted parallel to the longitudinal axis of the platen assembly, the plurality of rollers configured to sequentially and radially interact with the staggered curved surfaces and peristaltically occlude the at least one transfer tube between the rollers and the staggered curved surfaces.

2. The peristaltic pump of claim 1, wherein the at least one transfer tube is wrapped around the outer circumference of the platen assembly.

3. The peristaltic pump of claim 1, further comprising:

a manifold assembly operatively coupled to at least one of the input end and the output end and including at least one connector configured to secure the at least one transfer tube to the manifold assembly.

4. The peristaltic pump of claim 3, wherein the at least one connector includes at least a first connector and a second connector, the first connector having a first inside diameter and a first wall thickness and the second connector having a second inside diameter and a second wall thickness.

* * * * *